US006910706B2

(12) United States Patent
Holzer et al.

(10) Patent No.: US 6,910,706 B2
(45) Date of Patent: Jun. 28, 2005

(54) BINDING UNIT FOR SPORTS DEVICES, IN PARTICULAR FOR A SNOWBOARD

(75) Inventors: Helmut Holzer, St. Johann (AT); Max Luitz, Blaichach-Bihlerdorf (DE)

(73) Assignee: Atomic Austria GmbH, Altenmarkt im Pongau (AT)

( * ) Notice: Subject to any disclaimer, the term of this patent is extended or adjusted under 35 U.S.C. 154(b) by 90 days.

(21) Appl. No.: 10/227,233

(22) Filed: Aug. 23, 2002

(65) Prior Publication Data

US 2003/0047913 A1 Mar. 13, 2003

(30) Foreign Application Priority Data

Aug. 29, 2001 (AT) ..... A 1368/2001

(51) Int. Cl.[7] ..... A63C 9/00
(52) U.S. Cl. ..... 280/618; 280/629; 280/14.24
(58) Field of Search ..... 280/11.3, 11.32, 280/11.33, 613, 620, 625, 618, 626, 628, 629, 14.21, 14.22, 14.24

(56) References Cited

U.S. PATENT DOCUMENTS

| | | | | | |
|---|---|---|---|---|---|
| 5,344,178 | A | * | 9/1994 | Rohrmoser | 280/617 |
| 5,344,179 | A | * | 9/1994 | Fritschi et al. | 280/618 |
| 5,356,170 | A | * | 10/1994 | Carpenter et al. | 280/618 |
| 5,868,416 | A | * | 2/1999 | Fardie | 280/607 |
| 6,015,161 | A | | 1/2000 | Carlson | |
| 6,092,829 | A | * | 7/2000 | Mercier | 280/617 |
| 6,155,578 | A | * | 12/2000 | Patterson | 280/14.24 |
| 6,467,794 | B1 | * | 10/2002 | De France | 280/607 |
| 6,520,531 | B1 | * | 2/2003 | Gien | 280/618 |
| 6,604,746 | B1 | * | 8/2003 | Sato et al. | 280/14.22 |

FOREIGN PATENT DOCUMENTS

| | | |
|---|---|---|
| EP | 0756882 | 2/1997 |
| EP | 0761261 | 3/1997 |
| EP | 0815905 | 1/1998 |
| FR | 2 627 0978 | 8/1989 |
| FR | 2743306 | 7/1997 |
| WO | WO 97/33664 | 9/1997 |
| WO | WO/0004964 | 2/2000 |

* cited by examiner

*Primary Examiner*—Christopher P. Ellis
*Assistant Examiner*—Christopher Bottorff
(74) *Attorney, Agent, or Firm*—Collard & Roe, P.C.

(57) ABSTRACT

For the purpose of fixing a binding unit (1) to a snowboard (4), this binding unit (1) is provided with a retaining disc (12), which is substantially circular as seen in plan view, for a base plate (11) of relatively large surface area. Mounted on this base plate (11), either directly or indirectly, are coupling parts to provide a connection to a snowboard shoe. Teeth (49, 51) are provided between the base plate (11) and the retaining disc (12) inserted therein through a central orifice (15). The teeth (49, 51) securely fix selectively adjustable and fixable angular positions between the retaining disc (12) and the base plate (11). At least one slide element (24, 25) is provided on the retaining disc (12) and is displaceable between an extracted position (26), in which it spans or overlaps a transition region (28) between the retaining disc (12) and the base plate (11), and an inserted position, in which the slide element (24, 25) does not span or overlap this transition region (28). The slide element prevents the base plate from being lifted off the retaining disc in the extracted position while enabling it to be lifted off in the inserted position.

33 Claims, 10 Drawing Sheets

BINDING UNIT FOR SPORTS DEVICES, IN PARTICULAR FOR A SNOWBOARD

BACKGROUND OF THE INVENTION

1. Field of the Invention

The invention relates to a binding unit for sports devices, in particular for a snowboard, which, for the purpose of fixing it to the sports device, is provided with a retaining disc, which is substantially circular as seen in plan view, for a base plate of relatively large surface area with coupling parts mounted directly or indirectly thereon to provide a connection to a sports shoe, in particular a snowboard shoe, which can be released as necessary, and having teeth between the base plate and the retaining disc inserted therein through a central orifice or corresponding recess, the purpose of the teeth being to securely fix selectively adjustable and fixable angular positions between the retaining disc and the base plate.

2. The Prior Art

Snowboard bindings which allow the angular position of the base plate relative to the circular retaining disc rigidly joined to the sports device to be adjusted are known from the prior art and are disclosed in the patent specifications of European patent applications EP 0 756 882 A, EP 0 761 261 A and EP 0 815 905 A, for example. In these instances, teeth are preferably provided between the retaining disc and the base plate as a means of adjusting the angular position in stages and guarantee a high-strength lock of the desired angular position. These binding units have various adjusting and fixing mechanisms which are indirectly mounted on the base plate and permit or prevent a relative rotation between the base plate and the retaining disc by means of a series of mechanisms. One disadvantage of the known binding units resides in the fact that either the base plate and retaining disc can be torn apart by a maximum force that is relatively low or the release and locking mechanism used to adjust the angle of rotation can only be operated by applying a considerable amount of force.

SUMMARY OF THE INVENTION

The underlying objective of the present invention is to provide a binding unit for sports devices, in particular for a snowboard, which enables the angular position relative to the sports device to be changed rapidly and effortlessly. Irrespective of the above, another objective of the invention is to improve the binding unit by optionally incorporating simple technical means so that the relative position of the binding unit can be changed in the longitudinal direction of the sports device rapidly and with out complications.

The first of said objectives of the invention is achieved due to the fact that at least one slide element is provided on the retaining disc, which can be adjusted from an extracted position, in which it spans or bridges a transition region between the retaining disc and the base plate, into an inserted position in which the slide element does not span or overlap the transition region between the retaining disc and the base plate, and vice versa.

The advantage of this is that the slide elements of the adjusting and locking mechanism for the individual angular positions are mounted directly on the retaining disc. This provides a simple means of adjusting the base plate relative to the outer periphery of the retaining disc on the one hand and also enables a high-strength, mechanically secure lock for the base plate on the sports device. With only a few manipulations, it is possible at any time to shift the slide elements into the inactive or inserted position and adapt the angular position of the base plate or binding to the respective requirements or needs by applying slight positioning and sliding forces. Likewise, the binding can be locked or fixed in the desired angular position particularly rapidly and effortlessly with only relatively light operating forces. The sliding elements provide a high-strength and mechanically reliable locking action of the base plate on the sports device whilst enabling the angular adjusting mechanism to be operated effortlessly and accurately without problem, even for children. As a result of the generously dimensioned guide lengths and transverse dimensions, the slide elements are also capable of withstanding high mechanical stresses without imparting the general impression of being heavy-going or awkward. The fact of being simple and rapid to adjust is of benefit not just to training schools and establishments hiring out sports equipment, but also means that the binding can be adjusted and re-set at any time during active use of the sports device on the piste or any other slope.

The fact that at least two slide elements are adjustably mounted on the retaining disc, either in a diametrically opposite layout or spanning a peripheral region thereof, with portions projecting beyond the circular periphery of the retaining disc in their extracted position, imparts high mechanical stability to the binding unit in the region between the retaining disc and the base plate, particularly as the slide elements are mounted so as to be adjustable relative to the longitudinal direction of the base plate. When the slide elements are in the extracted position, the slide elements also help to increase the flexural strength of the base plate. Furthermore, because of the generously dimensioned linear guides in the retaining disc, the adjustably mounted slide elements can be accommodated in a particularly stable arrangement and with durable positional accuracy. Another advantage of this arrangement is the fact that a coupling with the retaining disc can be provided without the need for complex mechanical parts on the actual base plate.

The slide elements can be mounted and guided in the most stable arrangement possible due to the fact that the slide elements can be adjusted at least almost radially relative to the retaining disc.

Of particular advantage is another embodiment in which an adjusting mechanism is provided whereby several slide elements can be synchronously adjusted and coupled in displacement in different directions, because all slide elements can be moved into the extracted or inserted position simultaneously by operating only a single adjusting mechanism or handle.

In one possible embodiment, the adjusting mechanism is provided in the form of a pinion or gear disposed at the centre of the retaining disc and is connected to the slide elements in a driving arrangement. The advantage of this is that high driving or displacement forces can be transmitted between the driving pinion or gear which imparts the adjusting motion and the slide elements.

Also of advantage is a binding unit in which at least one spring means is provided, which forces the slide elements into the extracted position, since the slide elements are always forced into the extracted position or position providing a coupling with the base plate without risk of being torn out.

Inexpensive and readily adaptable spring means of durable strength and high breaking resistance, which are also simple to mount and position, are provided and the spring means consist of at least one helical spring disposed on the retaining disc which exerts a biassing force on the slide elements, continuously forcing them into the extracted position or into a position providing a positive coupling with the base plate.

The fact that the retaining disc is provided in the form of a gear with teeth on the end face and the teeth of the retaining disc and the teeth of the base plate disposed inside the orifice receiving the retaining disc are straight teeth, ensures that the base plate can be effortlessly lifted in a direction perpendicular to the retaining disc and set back down when the slide elements lie inside the circular outer periphery of the retaining disc. This also provides a high strength arrangement for preventing twisting in order to avoid any undesirable changes of angular position.

As a result of the positive connection formed when the matching teeth of the retaining disc and the base plate mesh to prevent mutual twisting relative to their mounting plane, a high-strength mechanism is provided which is resistant to vibrations and the effects of varying forces and affords a high retaining or fixing torque.

As a result of the embodiment in which the slide elements prevent the base plate from being lifted off the retaining disc in the direction perpendicular to their mounting plane when in the extracted position, the elements are quasi split or separated to prevent this lifting and to prevent twisting, enabling high retaining forces to be guaranteed whilst providing easy manipulation without the problem of sticking or jamming.

In another possible embodiment whereby a release and locking mechanism optionally releases and locks or checks displacement of the slide elements, the slide elements can be locked to prevent movement if necessary, ruling out any possibility of the anti-lift lock from being deactivated and thereby taking account of safety requirements to a high standard.

In the embodiment where the release and locking mechanism is provided in the form of a spring-biassed push-button, which can be selectively displaced into and out of positive engagement with at least one of the slide elements, the release and locking mechanism can be operated with ease without the need for tools and only a small space or area is needed for mounting the release and locking mechanism.

Another particularly advantageous embodiment is one in which the release and locking mechanism is pushed into its pulled-in or inserted position against the action of the spring means in order to deactivate locking of the slide elements. As a result of the second locking position of the release and lock mechanism, the slide elements can also be temporarily retained in the inserted position, which makes assembly and alignment of the retaining disc and the base plate significantly easier, reducing the amount of manipulation involved.

The embodiment in which the release and locking mechanism is designed to securely fix or lock the slide elements in their extracted or pulled-out position can also rule out any undesirable loosening of the anti-lift lock if the binding is subjected to rough handling, thereby giving the user of the operating mechanism a greater feeling of safety.

The binding unit can be assembled and re-set in a particularly rapid and simple manner, due to the fact that when the release and locking mechanism is released by the spring tensioning of the spring means, the slide elements automatically shift from an inserted position to the extracted position. Furthermore, incorrect connections between the retaining disc and the base plate due to lack of attention or carelessness on the part of the user can be ruled out.

In another embodiment the release and locking mechanism is designed for selectively releasing and locking or checking rotation of the pinion or gear for the slide elements. The advantage of this is that the locking forces are distributed uniformly across all slide elements.

It is also of advantage if the release and locking mechanism has an operating element which also forms a handle for rotating the pinion or gear, since this will make the operating element multi-functional so that it can be used as a release and locking element for the release and locking mechanism on the one hand and at the same time as a handle, making operation of the adjusting mechanism lighter and more forceful. This also reduces the number of parts needed for the binding unit.

A structurally simple and yet secure fixing and locking action can be achieved, which also makes the active functional state visible at any time, due to the fact that the handle can be pivoted about an axis running parallel with the standing plane for a sports shoe, from a non-operating position in which it lies in the standing plane into an active position folded out from or standing up from the standing plane, and vice versa. Also of particular advantage is the fact that the sports shoe can not be placed in the binding if the release and locking mechanism is in the unlatched or released state. This further enhances the operating safety of the binding unit.

A multi-functional handle, which naturally makes for more convenient operation and reduces the amount of time needed to adjust or re-adjust the binding unit, is provided, whereby the handle which the adjusting mechanism, in particular the pinion, from rotating when shifted to the non-operating position.

The fact that the retaining disc remains rigidly joined to the sports device whenever the angular position of the base plate is changed by means of fixing screws, known per se, is an advantage because, whilst the retaining disc will always remain rigidly joined to the sports device it will nevertheless permit the angular position of the binding unit to be adjusted. In particular, a retaining disc of the type used with the binding unit proposed by the invention will always remain firmly joined to the snowboard and does not have to be loosened to make an angular adjustment unless it is necessary to adjust the relative position of the entire binding unit relative to the sports device. Another specific advantage is that such sports devices, in particular those referred to as snowboards, can be stowed or stored with the retaining disc still mounted on them, thereby saving on space. This is of particular advantage for ski hire shops or training facilities on the one hand and for wholesalers or manufacturers of such sports equipment and binding units. The end user will also have the benefit of easier handling and less storage space or room due to this system, whereby the snowboard and retaining disc on the one hand and the base plate together with the sports shoe can be stored in this uncomplicated and space-saving manner.

Since the retaining disc can be pre-assembled with a sports device as a unit in the workshop or by a retailer, the manipulation needed prior to selling, hiring and despatching such sports devices with the requisite binding units is significantly reduced.

One particularly advantageous improvement provided by the binding unit proposed by the invention is the fact that the slide elements have inclined surfaces running at an angle to the standing plane at opposing end regions and/or inclined surfaces extending at an angle to the standing plane are provided in a peripheral region around the orifice in the base plate. Firstly, this enables any manufacturing tolerances to be compensated and the components can be designed with relatively generous inherent tolerances. The inclined surfaces nevertheless enable the retaining disc to be connected to the base plate in an arrangement that is as clearance-free as possible. Even the occurrence of abrasion and wear due to long-term use and high stress on the components will hardly impair the connection quality. In particular, this design ensures that an exact fit between the retaining disc and the base plate can be efficiently maintained in the long term and the join clearance between the retaining disc and the base plate will not become significantly bigger, even under the effect of sharply varying forces. Optionally, use can also be made of the clamping action imparted to them as a result of the clamping mechanism formed by the inclined surfaces to reliably fix the entire relatively displaceable binding unit to the sports device, as will be explained below.

The slide elements can be accurately and durably mounted and guided without being susceptible to jamming due to the fact that the retaining disc has guide elements, e.g. guide pins and/or elongate guide recesses, to provide a linear guide for the slide elements.

In one possible embodiment of the binding unit, in which the contour of the base plate substantially matches that of a shoe sole, the binding unit will firstly look visually attractive and secondly the rigidity of the sports device, in particular the snowboard, can be reduced as far as possible in spite of the rigidly connected base plate.

A sports shoe can be rapidly and effortlessly placed in and removed out of the binding unit due to the fact that the coupling parts are provided in the form of at least one catch coupling, which may be detachable if necessary, or at least one strap system with at least one buckle or clamp.

A connection of the retaining disc to the sports device and quick assembly of the binding unit on a snowboard is made possible by another embodiment, in which at least one positive connecting means is provided on the bottom face of the retaining disc and connects in a positive fit with a matching connecting means on the top face of a sports device, obviating the need to provide other fixtures or otherwise process the top face of the sports device.

Of particular advantage is another embodiment in which the positive connecting means of the retaining disc form a guide system which may be locked and released as required in conjunction connecting means of a matching or complementary shape on a sports device, so as to enable a relative displacement of the binding unit in the longitudinal direction of the sports device. This will enable the individual angular adjustment to be made with little manipulation as well as the relative position of at least one binding unit to be adjusted or readjusted relative to the sports device.

A stable, positive connection between the binding unit and the sports device, which will also permit the relative position of the binding unit to be readily and rapidly adjusted relative to the sports device if necessary, is achieved due to the fact that the positive connecting means of the retaining disc is provided in the form of at least one projection standing proud of its bottom face, which is selectively adjustable and fixable in at least one guide groove provided in the top face of a sports device. Another advantage of this is that the sports device, in particular the snowboard, may be of a substantially planar or flat design in the binding mounting region but this will not impair adjustment of the rotation angle of the base plate.

The complementary design providing a positive connection between the retaining disc and the sports device is achieved by the fact that the positive connecting means is provided in the form of at least one groove-shaped recess in the bottom face of the retaining disc and can be displaced in a positive and relative sliding connection with a complementary or matching ledge-shaped raised section on the sports device. The advantage of this is that it is easy to provide the groove-shaped recesses in the bottom face of the retaining disc and there will be no need to provide any additional projections or elements on the retaining disc to connect it to the sports device. Designed accordingly, it will still be possible to change the angular position of the base plate relative to the retaining disc.

The embodiment of the binding unit provided with the matching projections and guide grooves or alternatively with the matching groove-shaped recesses and ledge-shaped raised sections permit a relative displacement of the retaining disc or the entire binding unit in the longitudinal direction of the sports device due to a slight vertical clearance when the slide elements are in the inserted position, which enables the binding unit and the retaining disc to be displaced in the guide system on the sports device with relative ease and without jamming.

The other objective of the invention is achieved due to the fact that when the slide elements are moved into the extracted position via the inclined surfaces, a clamping or retaining force is generated between co-operating contact surfaces between the positive connecting means, in particular between the projections and the guide grooves and/or between the bottom face of the base plate and the top face of the sports device, which is able to prevent free or undesirable relative displacements between the retaining disc or the entire binding unit in the direction of the longitudinal axis of the sports device. This structural design provides an activatable and de-activatable clamping mechanism, capable of selectively permitting or preventing relative displacements between the binding unit or retaining disc and the guide system on the sports device. Of particular advantage in this respect is the fact that this clamping mechanism can be activated and deactivated simultaneously with the release and locking mechanism of the adjusting mechanism for adjusting the angle of rotation. In particular, the release and locking mechanisms are coupled with one another for the purpose of changing the angle of rotation and for altering the relative positioning by totally simple means and requiring no extra fixtures. Consequently, it is necessary to operate only a single release and locking mechanism or adjusting mechanism in order to adjust and fix both the angular position and the relative position of the binding unit with respect to the sports device. The time needed to change the angular position and the relative position of the binding unit with respect to the sports device can therefore be reduced quite considerably.

A clamping mechanism for permitting and preventing a relative displacement of the binding unit with respect to the sports device, which can be selectively activated and deactivated and is forcibly coupled depending on the respective state of the angular position adjusting mechanism and the position of the slide elements, is achieved due to the fact that when the slide elements are in the inserted position, a positive connecting means permits a limited, slight displacement of the retaining disc relative to the top face of a sports device.

Advantageously, there is absolutely no need to remove the base plate and the extra components on it from the snowboard or from the retaining disc because an anti-liftoff restriction is provided on the retaining disc which allows the base plate to be rotated when placed on the sports device but totally prevents the base plate from being removed from the retaining disc. Any risk of the base plate being lost or misplaced can therefore be ruled out.

BRIEF DESCRIPTION OF THE DRAWINGS

The invention will be explained in more detail below with reference to examples of embodiments illustrated in the appended drawings, wherein.

DETAILED DESCRIPTION OF PREFERRED EMBODIMENTS

Figure 1:
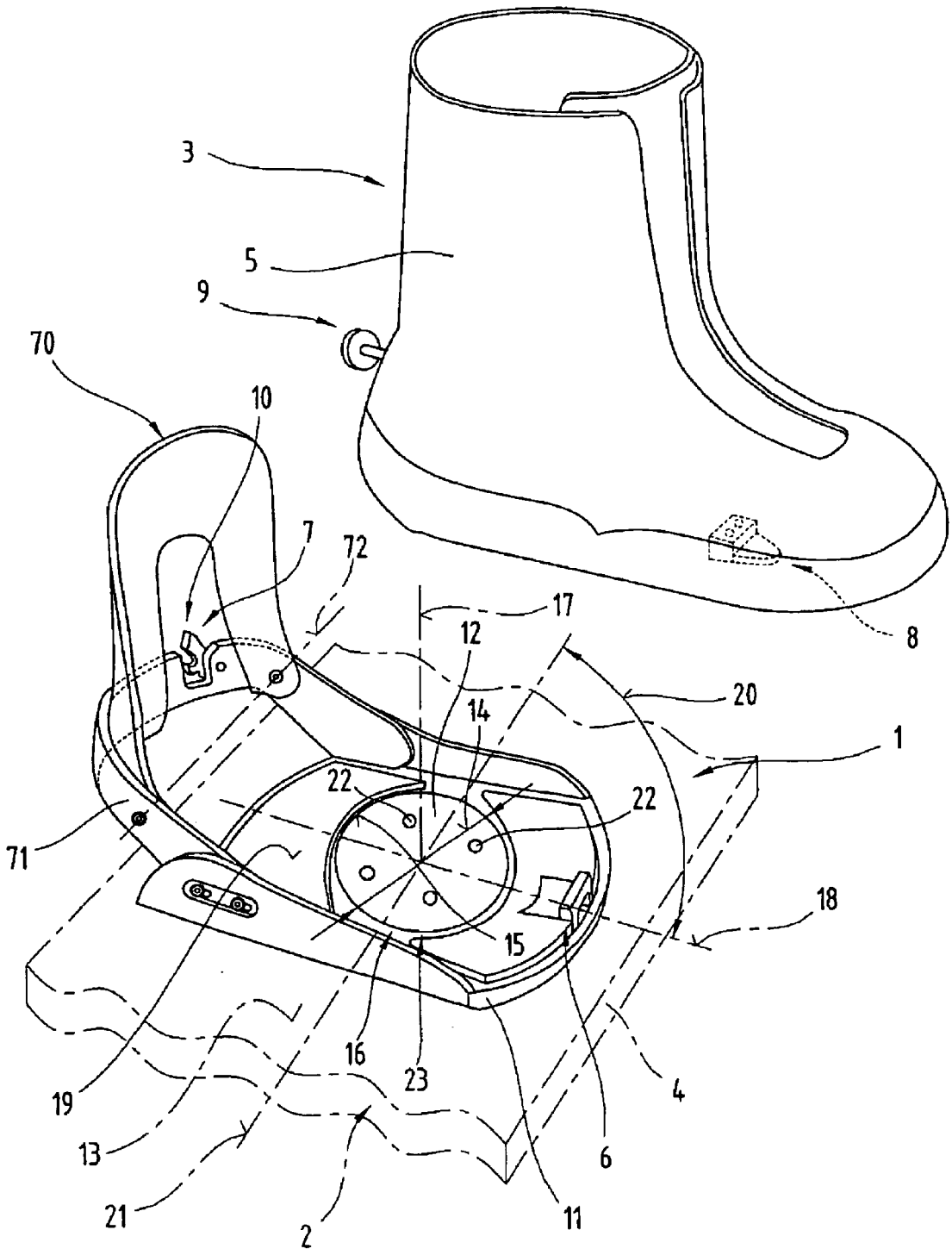
FIG. 1 is a very simplified diagram, in perspective, of an example of one possible embodiment of a binding unit for detachably connecting a snowboard shoe to a snow board.
Figure 2:
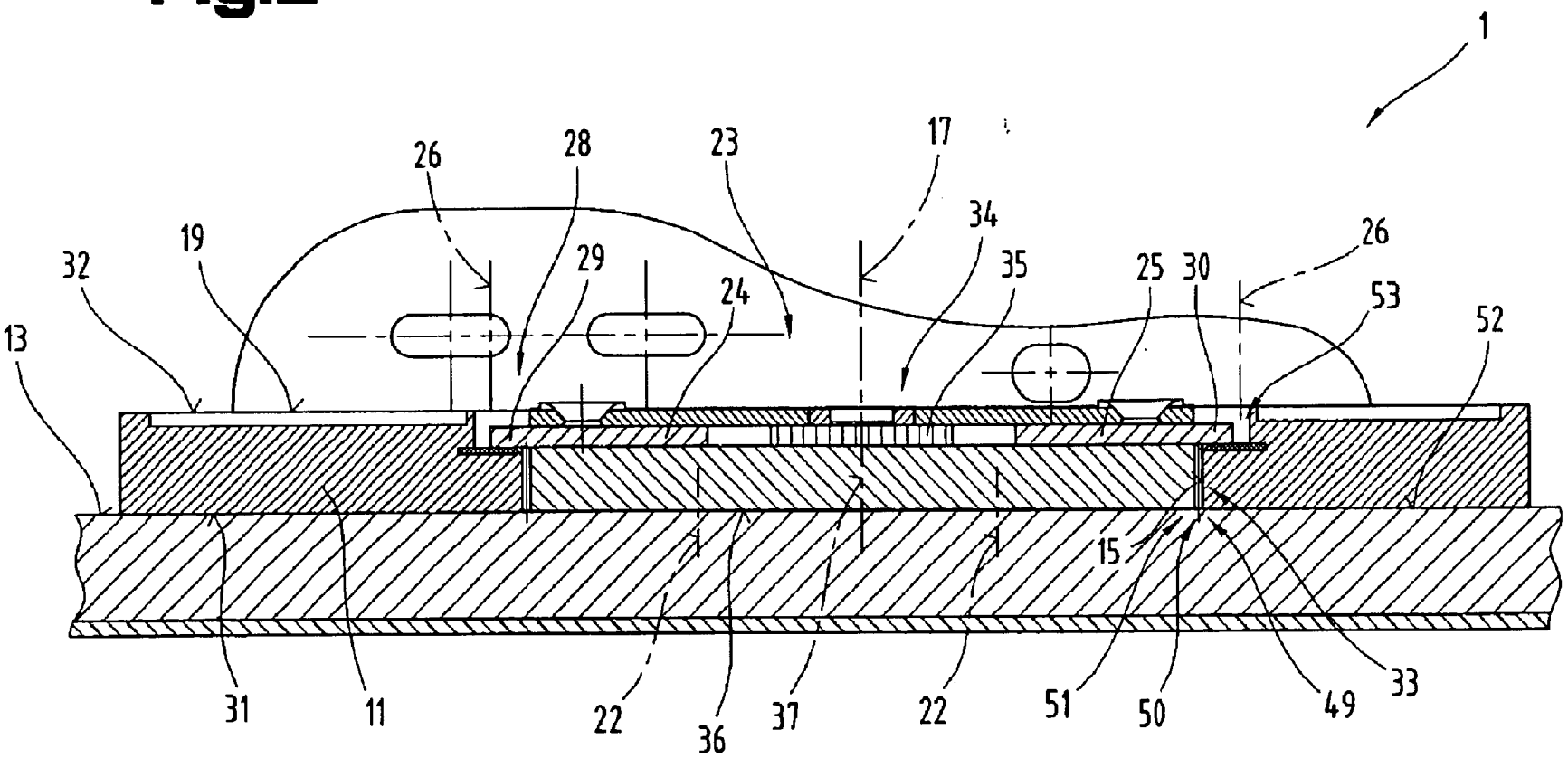
FIG. 2 is a very simplified, schematic diagram of a base part for a binding unit as proposed by the invention, seen in longitudinal section, together with a board-type sports device.
Figure 3:
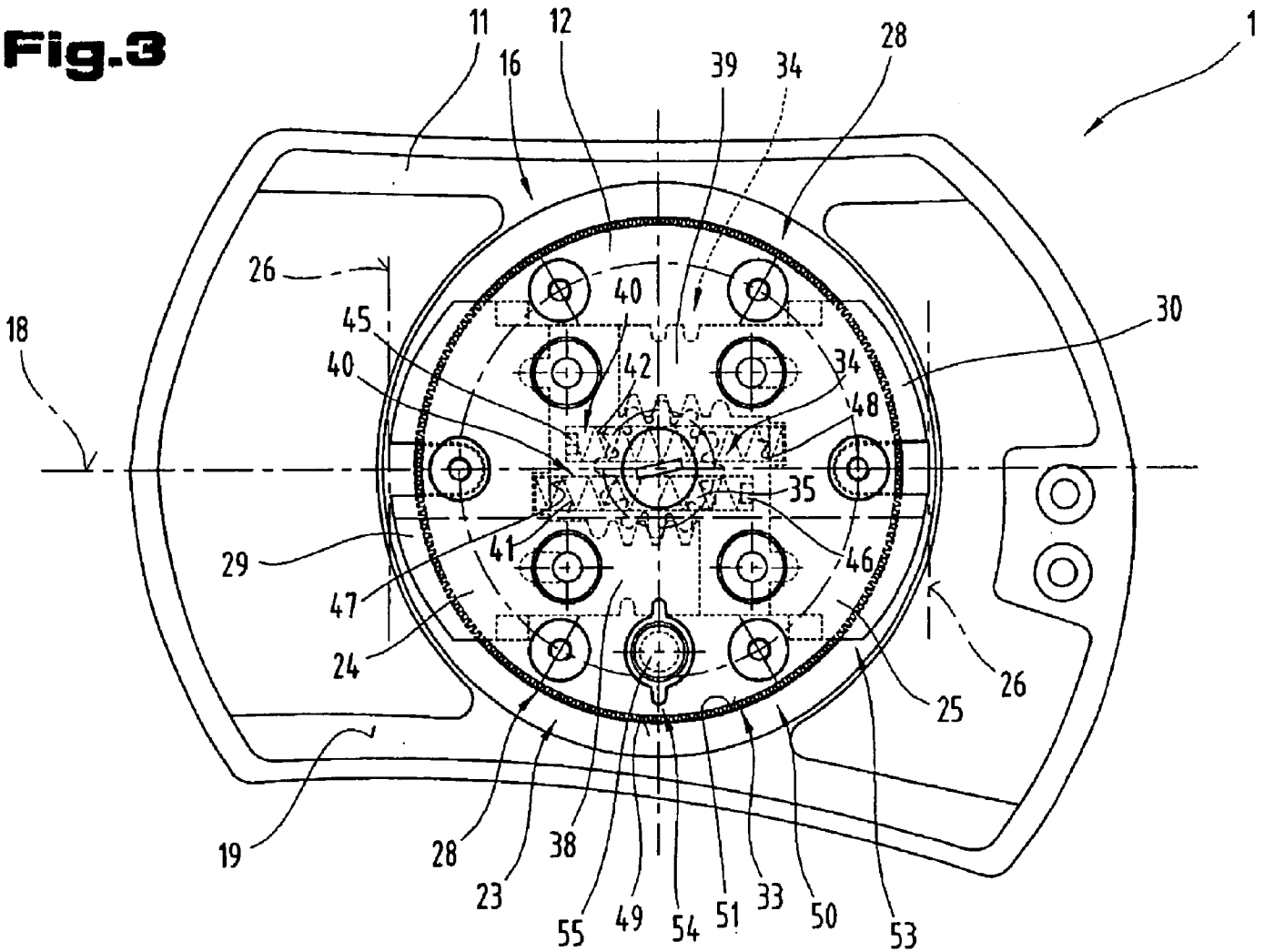
FIG. 3 is a simplified, schematic diagram showing component parts of the binding unit illustrated in FIG. 2 to be connected to a sports device, with the central adjusting mechanism for the slide elements.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc,. relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIG. 1 is a perspective diagram of a binding unit 1 for connecting a gliding device, in particular a board-type sports device 2, to a sports shoe 3, so that it can be detached as necessary. By preference, the sports device 2 is what is known as a snowboard 4, on which the binding unit 1 is mounted so as to releasably connect with a snowboard shoe 5 designed accordingly.

The binding unit 1 has at least one coupling part 6, 7 which releasably connects with at least a corresponding coupling part 8, 9 on the sports shoe 3. The coupling parts 6 to 9 form a catch coupling 10 and a so-called "step-in-system", preferably operable without tools, for comfortably and rapidly connecting and releasing sports shoe 3 and binding unit 1.

Still within the scope of the invention, the coupling parts 6, 7 of the binding unit 1 may be provided in the form of a known strap arrangement. Such strap arrangements, known from the prior art, have at least one strap-shaped tensioning element with a buckle or some other clamping mechanism, by means of which the sports shoe 3 is tightly strapped into the binding unit 1 and unstrapped again in order to step out of the binding unit.

The coupling part 9 of the sports shoe 3 may be provided in the form of a bolt-shaped projection in the heel region thereof. The other coupling part 8 on the sports shoe 3 may be provided in the form of a tongue-like retaining projection on the sole thereof, which can be placed in positive engagement with a recess or retaining shackle on the binding unit 1. The other coupling part 7 of the binding unit 1 may be a pivotably mounted, displaceable hook element which connects with the heel-end coupling part 9, of the type long known from the prior art.

The binding unit 1 also has a substantially planar base plate 11, which is retained on the top face 13 of the snowboard 4 by means of a retaining disc 12. As seen in plan view, the base plate 11 preferably has a contour more or less akin to that of a shoe sole. However, the base plate 11 could also be designed in the form of a beam-shaped support, with couplings elements in its end regions for connecting to a correspondingly designed shoe.

As seen in plan view, the retaining disc 12 for retaining the base plate 11 and the entire binding unit 1 on the snowboard 4 has a circular contour. A thickness of the wheel-type retaining disc 12 corresponds more or less to a thickness of the base plate 11. The retaining disc 12 may be 70 mm to 140 mm, preferably approximately 105 mm, in diameter 14.

In its central region, the base plate 11 has a circular orifice 15 or a corresponding recess, the diameter of which substantially corresponds to the diameter 14 of the retaining disc 12. The retaining disc 12 and the base plate 11 can be placed via the orifice 15 or the recess at least partially one inside the other and joined in a positive fit. The circular disc-shaped retaining disc 12 in conjunction with the complementary orifice 15 or corresponding recess forms a lockable and releasable pivot bearing 16 for the base plate 11 relative to the top face 13 of the snowboard 4. In particular, this pivot bearing 16 forms an axis 17 disposed essentially perpendicular to the base plate 11 and the top face 13 of the snowboard 4, extending parallel with the binding vertical axis and congruent therewith.

Imitating the sole shape of the sports shoe 3, the base plate 11 is preferably of an asymmetrical design by reference to the binding longitudinal axis 18. This binding longitudinal axis 18 preferably extends through the centre of the retaining disc 12 and is aligned essentially parallel with a standing plane 19 for the sports shoe 3. The standing plane 19 for the sports shoe 3 on the base plate 11 may extend as far as possible parallel with the top face 13 of the snowboard 4 or may also be inclined at an angle to the top face 13 of the snowboard 4 for performing what is referred to as "canting".

The selectively lockable and releasable pivot bearing 16 between the retaining disc 12 and the base plate 11 allows the binding unit 1 to be adjusted to different angular positions relative to the snowboard 4. In particular, in a known manner, it enables an angle of rotation 20 between the binding longitudinal axis 18 and a longitudinal axis 21 of the snowboard 4 to be changed to suit the desires of the user, after which the desired angle of rotation 20 can be fixed. In particular, this pivot bearing 16 enables the angle of rotation 20 to be adjusted to anywhere between the "Regular" angular position to the "Goofy" position and vice versa. Likewise, this pivot bearing 16 also enables the binding longitudinal axis 18 to be changed from an alignment parallel with the longitudinal axis 21 to an alignment transverse to or at right angles to the longitudinal axis 21. Basically, the pivot bearing 16 is lockable and releasable but without stops, enabling the angle of rotation 20 to be adjusted over an adjustment range of 360°.

In a known manner, at least two binding units 1, either of an identical design or designed for the right and left feet, are mounted on a snowboard 4. It is standard practice to provide a plurality of fixing screws 22 for this purpose, which can be inserted through the retaining disc 12 and anchored in the snowboard 4 in order to hold the binding unit 1 on the top face 13. In the various embodiments known from the prior art, these fixing screws 22 have also fulfilled a function as a means of adjusting and fixing 23 the angle of rotation 20 of the pivot bearing 16. In order to change an angle of rotation 20, this has meant loosening all the fixing screws 22 for the retaining disc 12, adjusting the base plate 11 to the desired angle of rotation 20 and tightening the fixing screws 22 again with a high torque. This has also involved the use of tools, e.g. screwdrivers, and required relatively long re-adjustment times to carry out these operations.

FIGS. 2 to 7 illustrated an improved embodiment of an adjusting and fixing mechanism 23 for the angle of rotation 20 and the pivot bearing 16.

As may clearly be seen from these diagrams, the adjusting and fixing mechanism 23 between the retaining disc 12 and the base plate 1 has at least one adjusting or slide mechanism, preferably at least two slide elements 24, 25, which are retained on the retaining disc 12 and are displaceable relative thereto. Accordingly, the slide elements 24, 25 are adjustable from an extracted position 26—FIG. 3—to an inserted position 27—FIG. 7—and vice versa. The extracted position 26 corresponds to an active position, in which the adjusting and fixing mechanism 23 affords a rigid connection in all spatial directions between the retaining disc 12 and the base plate 11 via the slide elements 24, 25. The inserted position 27 of the slide elements 24, 25 corresponds to an inactive position of the adjusting and fixing mechanism 23, in which the base plate 11 can be displaced, in particular raised, relative to the retaining disc 12 in the direction perpendicular to the top face 13. In particular, when the slide elements 24, 25 are in the inserted position 27 and the adjusting and fixing mechanism 23 is in the inactive position, the base plate 11 together with the components arranged on it can be lifted off the retaining disc 12 and off the snowboard 4.

As also clearly illustrated, when the slide elements 24, 25 are in their extracted position relative 26 to the retaining disc 12, they span a transition region 28 between the retaining disc 12 and the base plate 11. In particular, in their extracted position 26, the slide elements 24, 25 positively engage with the base plate 11 and span this base plate 11 in the peripheral region around its circular orifice 15, at least in certain regions. Instead of this positively engaging arrangement of the slide elements 24, 25 in a region preferably set back around the orifice 15 of the base plate 11, it would naturally also be possible to provide grooves in the outer region of the orifice 15 in which end regions 29, 30 of the slide elements 24, 25 are able to engage in a positive, as far as possible clearance-free arrangement. Particularly in this embodiment, it is not absolutely necessary for the base plate 11 to have an orifice 15 extending continuously from its bottom face 31 through to its top face 32 and it would also be possible as an alternative to provide an adequate recess on the bottom face 31. Accordingly, the top face 32 of the base plate 11 may therefore have broad regions of a continuous and planar design.

On assuming the inserted position 27, the slide elements 24, 25 do not extend within the transition region 28 between the retaining disc 12 and the base plate 11, i.e. the slide elements 24, 25 are retracted into the retaining disc 12 and do not therefore overlap and cover the transition region 28. Consequently, the base plate 11 can be effortlessly removed from the retaining disc 12 which is arranged on the snowboard 4 in a manner such that it can at least not be lifted.

It is of particular practical advantage that the slide elements 24, 25 are retained exclusively on the retaining disc 12 and are mounted so as to be displaceable relative thereto so that, in the extracted position 26, they can extend beyond or project out from a circular peripheral region 33 of the retaining disc 12. In the inserted position 27, on the other hand, the end regions 29, 30 of the slide elements 24, 25 are positioned within the circular peripheral region 33 of the retaining disc 12.

Essentially, it is possible to operate and displace the two diametrically opposed slide elements 24, 25 individually and independently of one another. However, the binding unit 1, in particular the retaining disc 12, preferably has an adjusting mechanism 34, by means of which a plurality, usually at least two slide elements 24 25, can be coupled in displacement. By preference, an adjusting mechanism 34 is designed to enable a synchronous displacement of at least two slide elements 24, 25 in different or opposite directions, as may be seen most clearly from FIGS. 3, 5 and 7.

This adjusting mechanism 34 is provided in the form of a gear or pinion 35 disposed at the centre of the retaining disc 12, meshing with the slide elements 24 25 to provide a drive connection. In particular, the pinion 35 is mounted so as to be rotatable about an axis 37 running through the centre of the retaining disc 12 and perpendicular to its bottom face 36. The pinion 35 is provided in the form of a gear with teeth on its end face. Portions 38, 39 of the slide elements 24, 25 mesh with diametrically opposite peripheral regions of the pinion 35. These portions 38, 39 constitute toothed racks as it were, which engage in a positive or meshing arrangement in opposing peripheral regions of the pinion 35. By preference, the slide elements 24, 25 and the toothed portions 38, 39 are made in the form of integral, plate-type parts of metal or plastics.

Similarly, the slide elements 24, 25 with the toothed portions 39, 39 may be a composite component of metal and plastics, in particular aluminium or steel, with hard plastics element moulded on.

Figure 13:
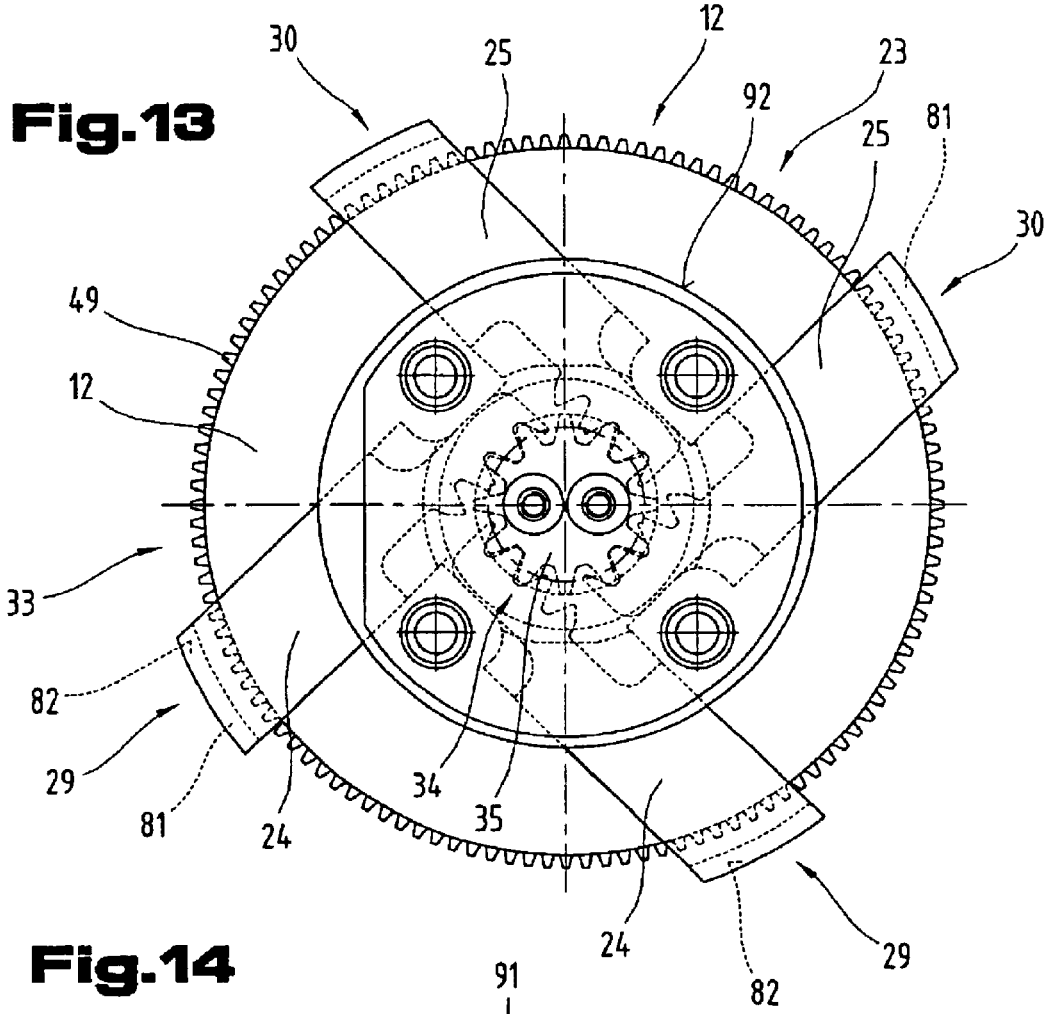
FIG. 13 is a plan view of another embodiment of the retaining disc for a base plate of the binding unit with four slide elements.
Figure 14:
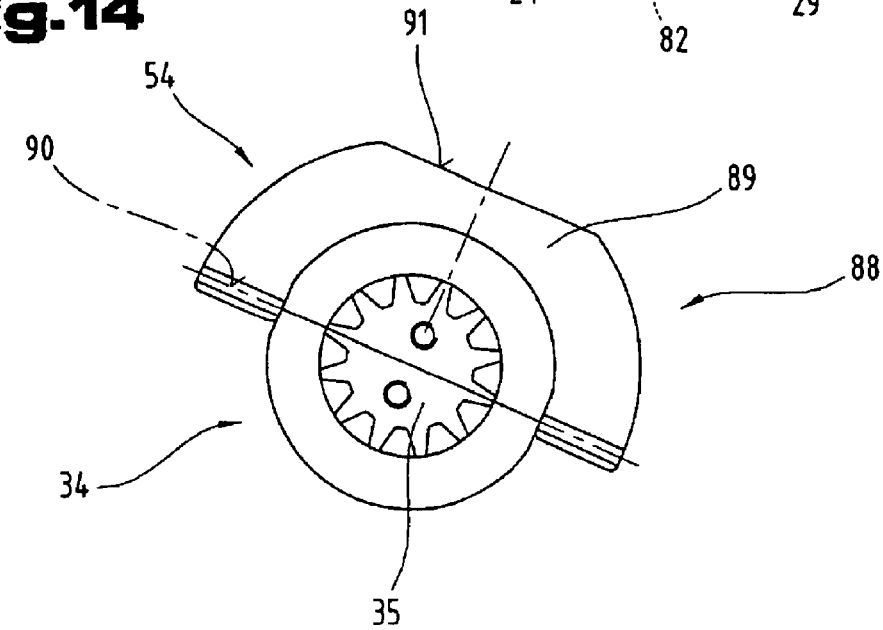
FIG. 14 shows a lever and a drive pinion for one possible embodiment of the central adjusting mechanism in the retaining disc.

Especially in situations where two slide elements 24, 25 are provided, they are preferably designed so as to be radially displaceable relative to the retaining disc 12. Alternatively, it would also be possible to provide four adjusting elements distributed around the peripheral region 33 of the retaining disc 12, coupled in displacement by means of a central gear wheel, as illustrated in FIG. 13. This being the case, the slide elements 24, 25 will then be at least almost radially displaceable relative to the retaining disc 12.

Instead of the design with a meshing connection between a pinion 35 and the slide elements 24, 25, it would naturally also be possible to generate transmission forces by means of a friction coupling between a central friction wheel and the slide elements 24, 25.

The binding unit 1, in particular the retaining disc 12, preferably also has at least one spring element 40, by means of which the slide elements 24, 25 are continuously forced into the extracted position 26. This at least one spring means 40 may be provided in the form of leaf springs on the slide elements 24, 25 and on the retaining disc 12. By preference, however, the spring means 40 are provided in the form of at least one helical spring 41, 42, in particular cylindrical compression springs.

These spring means 40 are mounted in two recesses 43, 44 in the retaining disc 12, substantially matching their external shape. By preference, two spring means 40 are provided, in which case the spring means 40 are supported respectively on a thrust bearing 45, 46 on the retaining disc 12 and at the other end respectively on a support surface 47, 48 on the slide elements 24, 25. The spring force of the spring means 40 is directed and dimensioned so that the slide elements 24, 25 are forced continuously outwards, in particular into the extracted position 26. The recesses 43, 44 for the spring means 40 are preferably arranged underneath the slide elements 24, 25 and underneath the pinion 35, as may be seen most clearly in FIG. 6.

The adjusting and fixing mechanism 23 between the retaining disc 12 and the base plate 11 also has teeth 49. These teeth 46 primarily serve as a means of securing and providing a high-strength lock for the selectively adjustable and fixable angular positions or angle of rotation 20 between the retaining disc 12 and the base plate 11. These teeth 49 therefore form a highly stable anti-rotation lock 50 between the circular retaining disc 12 and the base plate 11. In the active state, the teeth 49 or anti-rotation lock 50 therefore lock the actual pivot bearing 16 between the retaining disc 12 and the base plate 11.

As a result of its teeth 49, the retaining disc 12 is designed in the form of a disc with teeth on its end face or as a gear with teeth on its end face. The base plate 11 with the orifice 15 or recess for the retaining disc 12 has teeth 51 complementing or matching the teeth 49 on the retaining disc 12. The teeth 51 on the wall or external faces of the orifice 15 or the corresponding recess in the base plate 11 and the teeth 49 of the retaining disc 12 are designed in the form of straight teeth. In other words, the teeth of the two sets of teeth 49, 51 extend axially relative to the axis 37 and perpendicular to the bottom face 36 of the retaining disc 12 and perpendicular to the bottom face 31 of the base plate 11. When the retaining disc 12 and base plate 11 are placed one in the other, the complementary teeth 49, 51 form the anti-rotation lock 50 and prevent any twisting of said parts by reference to their common mounting plane 52, which is usually the top face 13 of a snowboard 4.

Whilst the complementary teeth 49, 51 afford an anti-rotation lock 50 against high twisting forces between the retaining disc 12 and the base plate 11, which is not strictly necessary but is effectively very practical, the slide elements 24, 25 in the extracted position act as an anti-liftoff lock 53 for the base plate 11 relative to the retaining disc 12 in the direction perpendicular to their mounting plane 52. The adjusting and fixing mechanism 23 between the retaining disc 12 and the base plate 11 is therefore provided firstly with an anti-rotation lock 50 and secondly with an anti-liftoff lock 53.

Essentially, the slide elements 24, 25 may be securely retained in the extracted position 26 or in their locking position solely by the force exerted by the spring means 40. By preference, however, the binding unit 1 or the retaining disc 12 also has a release and locking mechanism 54 for selectively releasing and locking or checking the displaceability of the slide elements 24, 25 and accordingly the positioning elements relative to the retaining disc 12 and relative to the base plate 11. In a preferred embodiment, the release and locking mechanism 54 for the slide elements 24, 25 has a push-button 55, operable by a user without tools and without the need for other aids. This push-button 55 is operable simply by depressing it with the finger and can be switched from an initial or non-operating position, in which the release and locking mechanism 54 is locked, into a release position 56, in which the release and locking mechanism 54 is released, as illustrated by broken lines in FIG. 6. On assuming the locking position 57, illustrated by solid lines in FIG. 6, the push-button 55 or at least a lock nose 58 thereof sits in a positive connection with at least one of the slide elements 24, 25, thereby preventing any relative displacement thereof relative to the retaining disc 12. The push-button 55 and a matching operating element of any design of the release and locking mechanism 54 is thereby forced by means of at least one spring element 59, for example a helical spring, rotary spring, leaf spring or similar, into the locking position 57 illustrated by solid lines. In the locking position 57 of the release and locking mechanism 54, a lock nose 58 of the push-button 55 preferably locates in at least one recess 60 or depression of at least one slide element 24, 25 thereby checking any possibility of a relative displacement of the slide elements 24, 25, in particular all of the slide elements 24, 25 which are coupled with one another in displacement by means of the adjusting mechanism 34.

Figure 4:
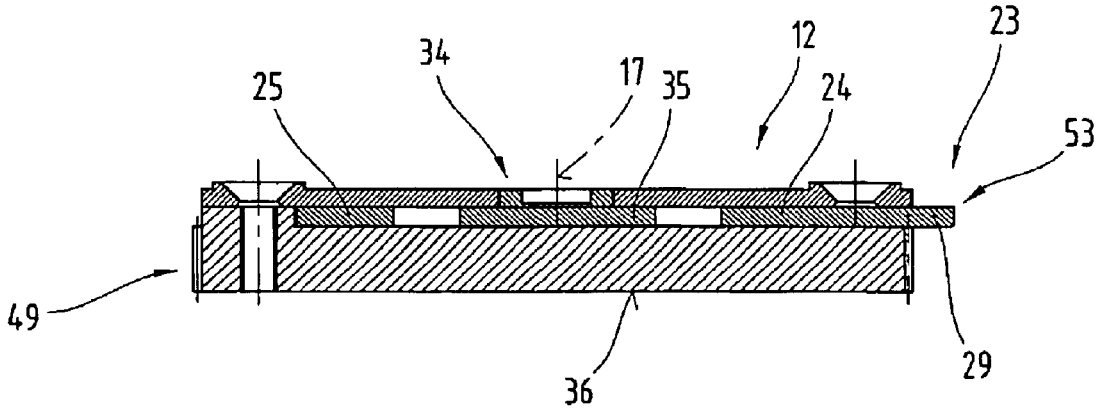
FIG. 4 is a longitudinal section along lines IV—IV indicated in FIG. 5 of a retaining disc of the binding unit proposed by the invention, with extracted slide elements.
Figure 5:
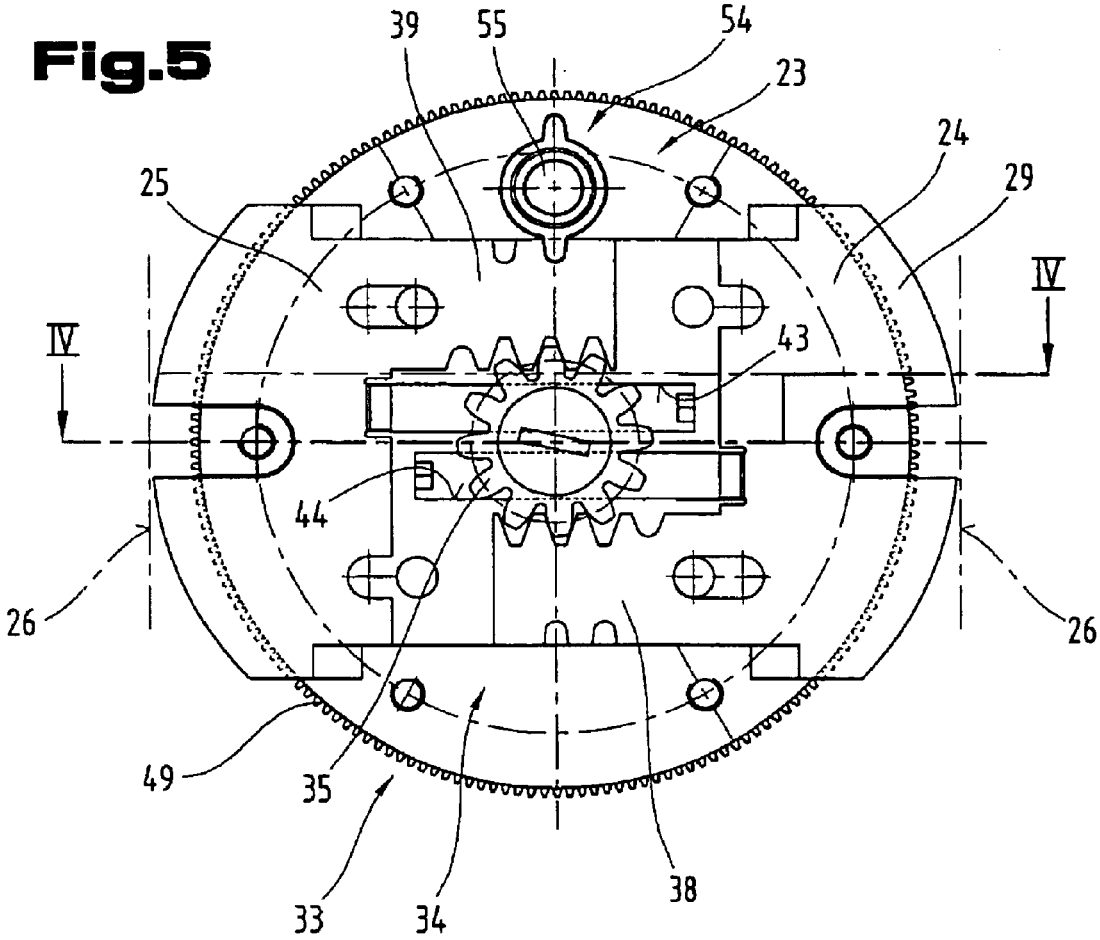
FIG. 5 is a simplified, schematic diagram of the retaining disc illustrated in FIG. 4, seen in plan view, with cladding or covering element removed.

The release and locking mechanism 54 preferably has two different locking positions for the slide elements 24, 25. In a first locking position, illustrated in FIGS. 6 and 7, the slide elements 24, 25 are retained or checked in their inserted position 27 against the spring force of the spring means 40. In the second locking position for the slide elements 24, 25—as illustrated in FIGS. 4, 5—the slide elements 24, 25 are retained or checked in their extracted position 26 by means of the release and locking mechanism. These two locking positions may be achieved in a simple manner by individual recesses 60, 61 spaced at distance apart, which can be selectively brought into positive engagement to fix the slide elements 24, 25 as desired by means of the push-button 55 or an appropriate operating element. The release and locking mechanism 54 illustrated therefore acts on the slide elements 24, 25. Naturally and still within the scope of the invention, it would also be possible to provide a release and locking mechanism 54 that would selectively release or check the adjustability of the adjusting mechanism 34, in particular the ability of the pinion 35 to rotate.

The recesses 60, 61 are preferably provided in the peripheral or side regions of the slide elements 24, 25.

Figure 6:
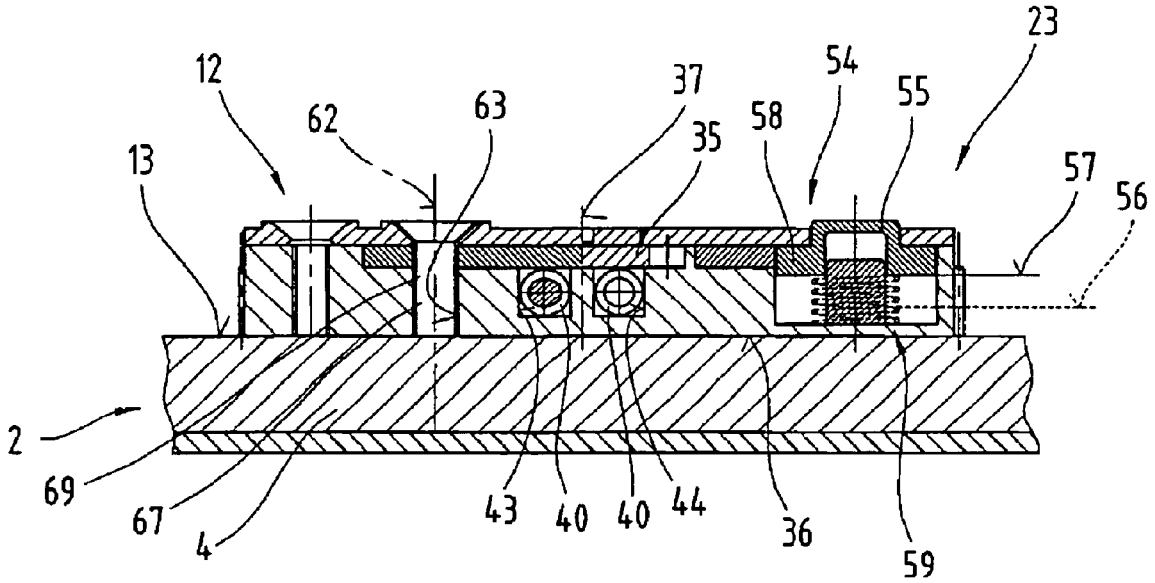
FIG. 6 is a view in section along lines VI—VI indicated in FIG. 7 of the retaining disc on a board-type sports device with cladding or covering element fitted.
Figure 7:
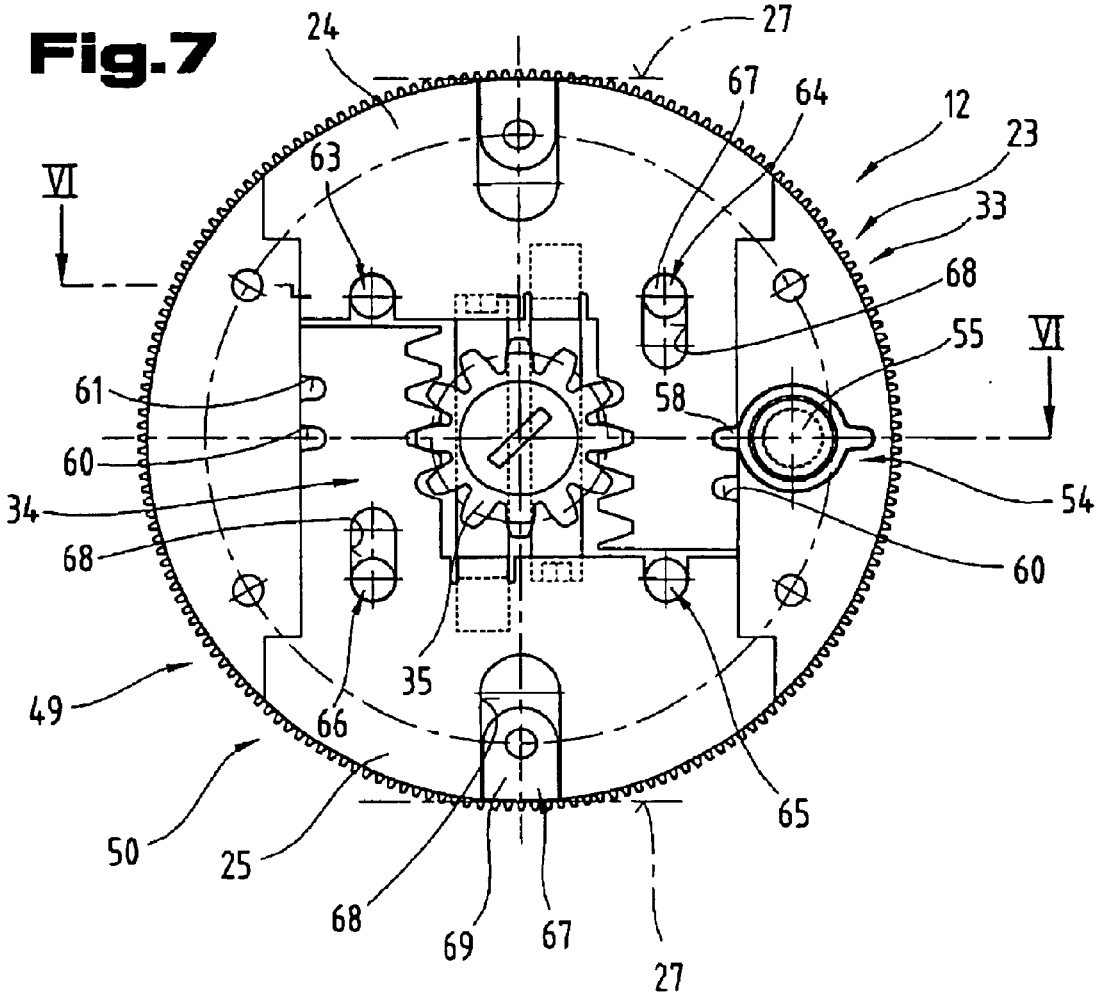
FIG. 7 is a simplified plan view showing the retaining disc when the slide elements illustrated in FIG. 6 are in the inserted state, with cladding or covering element removed.

In the second locking position illustrated in FIGS. 4, 5, the release and locking mechanism 54 prevents the slide elements 24, 25 from being inadvertently pulled back and the anti-liftoff lock 53 from being unintentionally deactivated. The release and locking mechanism 54 therefore ensures that the base plate 11 does not unintentionally work loose from the retaining disc 12, which could otherwise cause accidents. Another specific function of the release and locking mechanism 54 with its two locking positions is to allow the base plate 11 to be placed without problems on the retaining disc 12 already attached to the sports device 2 when the locking position illustrated in FIGS. 6 and 7 is assumed. Simply by operating the release and locking mechanism 54, in particular the push-button 55, the slide elements 24, 25 can then be automatically shifted due to the spring action to the extracted position 26, in which they establish the rigid connection between the retaining disc 12 and the base plate 11, which can not be torn apart. With a simple button or simply by operating the push-button 55, the base plate 11 can therefore be connected in its desired position or at its desired angle of rotation 20 to the retaining disc 12 and be prevented from rotating relative to the snowboard 4 and from being torn off.

In an effortless and rapid manner similar to that in which the base plate 11 is fixed or locked, the base plate 12 can also be released and removed from the snowboard 4 without tools, this being accomplished in a simple manner. Starting from the inserted position 27 of the slide elements 24, 25 as illustrated in FIGS. 6 and 7, the latter can be directly and automatically shifted into the extracted position 26 by releasing the release and locking mechanism 54 due to the force of the spring means 40.

Instead of the embodiment of the release and locking mechanism 54 illustrated here, it would naturally also be possible to provide locking pawls or similar to prevent the driving gear from rotating and allow the pinion 35 to be or selectively locked and released.

To operate the adjusting mechanism 34, in particular to adjust the slide elements 24, 25, projections or recesses may be provided on the pinion 35 or directly on the slide elements 24, 25, to facilitate the transmission of displacement forces. For example, part regions of the central driving gear or the pinion could be provided with a slit-shaped recess, in which a screwdriver or coin could be inserted as a drive means, as illustrated in FIGS. 5, 7.

The retaining disc 12 is preferably mounted on a standard snowboard 4 having the standard layout of bores or standardised arrangement of so-called inserts. The retaining disc 12 can be assembled with a corresponding snowboard 4—in a known manner—using standard fixing screws 62, which are preferably anchored in threaded insets or inserts in the top face 13 of the snowboard 4, as schematically indicated in FIG. 6. At least three, preferably four fixing holes 63 to 66 are preferably provided in the retaining disc 12 to attach the retaining disc 12 to the snowboard 4. These four fixing holes 63 to 66 for the retaining disc 12 are disposed at the corners of an imaginary square with a side length of approximately 40 mm, so as to overlap with standard mounting bores or inserts in a snowboard 4. The at least three, in particular four fixing holes 63 to 66 may be provided as circular bores or alternatively as oblong holes, to allow a certain relative displacement of the retaining disc 12 in the longitudinal direction of the snowboard 4.

However, it would also be possible to provide a plurality of anchoring points or inserts in the snowboard 4 in a known manner as a means of permitting this relative displacement of the retaining disc 12 and the binding unit 1 as a whole. Advantageously, the fixing screws 62 for fixing the retaining disc 12 simultaneously act as guide and/or stop elements for the slide elements 24, 25. In particular, a shank or threaded region or alternatively the screw head of the fixing screws 62 used may serve as a means of guiding the slide elements 24, 25 exactly in their intended adjustment direction and/or as a stop element to restrict the displacement path of the slide elements 24, 25 between their extracted position 26 and their inserted position 27, as may clearly be seen by comparing FIGS. 5 and 7. Alternatively, additional guide elements 67 may be provided on the retaining disc 12, which, by means of guide pins 69, for example by means of the fixing screws 62, and/or by means of oblong guide recesses 68, will assist in providing an exact linear guidance for the adjusting elements 24, 25.

One of the specific features of the binding unit 1 and the retaining disc 12 illustrated in FIGS. 2 to 7 is the fact that the retaining disc 12 can remain rigidly connected to the sports device 2 or the snowboard 4 by means of the fixing screws 62 whilst the angular position or angle of rotation 20—FIG. 1—of the base plate 11 relative to the sports device 2 is being adjusted. In particular, there is no need to loosen the fixing screws 62 of the retaining disc 12 in order to adjust the angle of rotation 20. The slide elements 24, 25 merely have to be shifted to the inserted position 27, the base plate 11 at least slightly lifted from the retaining disc 12 in order to adjust the angle of rotation 20 thereof and the base plate 11 replaced. The anti-liftoff lock 53 then merely has to be activated by shifting the slide elements 24, 25 into the extracted position 26.

The retaining disc 12 may also be assembled with the sports device 2 or the snowboard 4 as a pre-assembled unit in the workshop or by the retailer. Prior to despatching or selling or hiring the sports device 2, it will merely be necessary to fit a corresponding base plate 11 with the requisite coupling parts 6, 7 and lock it.

A sports device 2 of this type may also be stored in racking or shelving with the retaining disc 12 mounted on it, which will save on space. Particularly for facilities hiring out such sports devices 2 and snowboards 4, this unit comprising snowboard 4 and retaining disc 12 can be assembled rapidly and easily in a very simple operation with a base plate 11 of the requisite size and/or design and/or strength with the necessary extra fixtures, as illustrated in FIG. 1. Accordingly, the base plate 11 may already be provided with all the requisite extra components—as schematically illustrated in FIG. 1—and with the corresponding sports shoe 3, in particular coupled with the respective snowboard 4. It is recommended in particular that the snowboard shoes 5 be stored or stowed together with the associated base plate 11 and the requisite extra fixtures in a common, extremely space-saving arrangement.

These extra fixtures might include, amongst other things, a so-called heel support 70, which is usually mounted on a mounting bracket 71 or a so-called heel-loop of the binding unit 1, as illustrated in FIG. 1. This heel support 70 generally has an arcuate curvature in cross section and is rotatable, but limited by stops, about a pivot axis 72 almost parallel with the base plate 11. The purpose of this heel support 70 is primarily to increase or proportion more finely the pressure which the user exerts on the sports device 2 in the heel region. It is irrelevant whether the mounting bracket 71 is provided as a separate unit, as illustrated in FIG. 1, or as an integral unit with the base plate 11.

Figure 8:
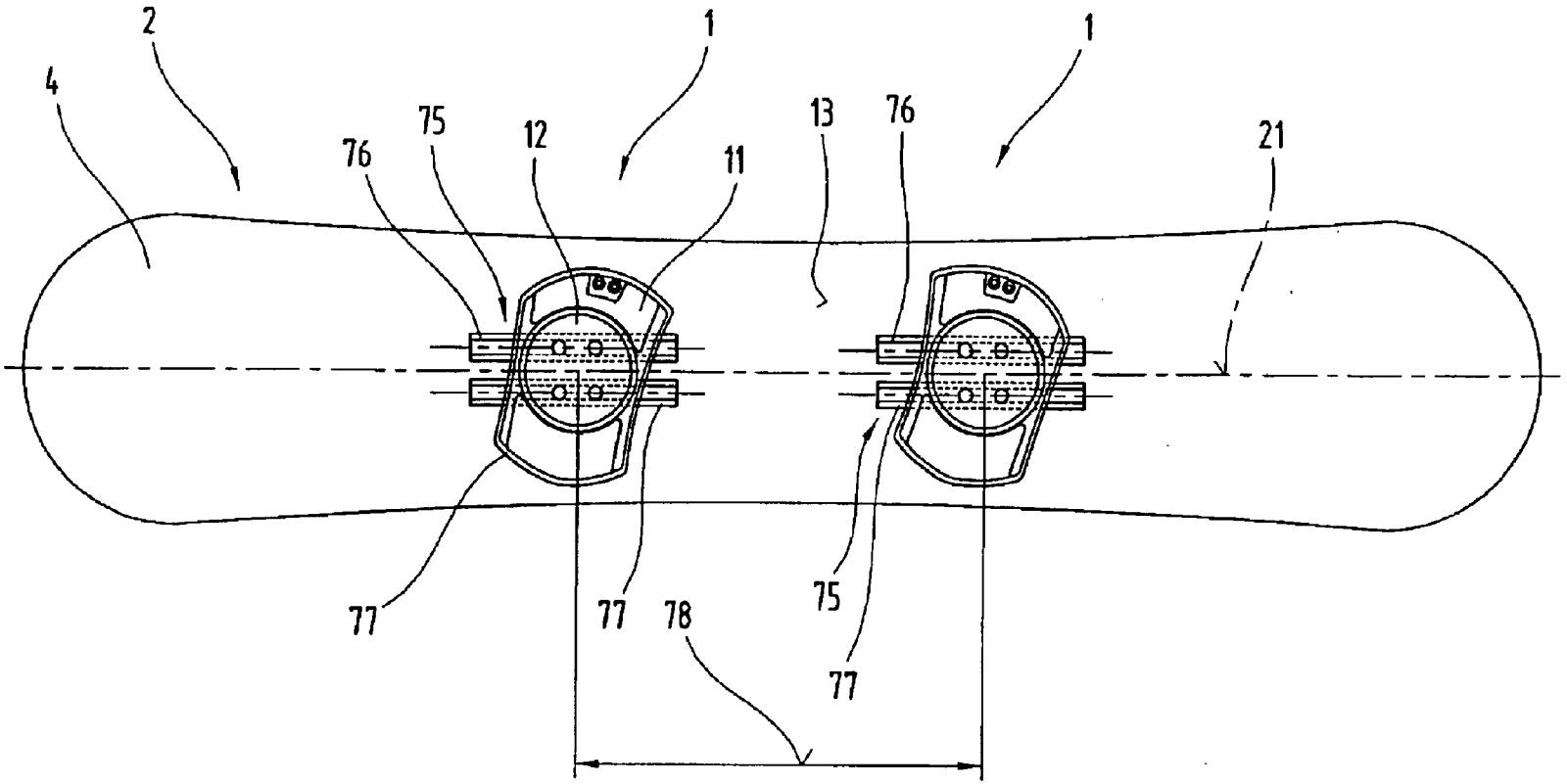
FIG. 8 shows a board-type sports device, in particular a snowboard, with the binding units mounted thereon in pairs by means of guide arrangements.
Figure 9:
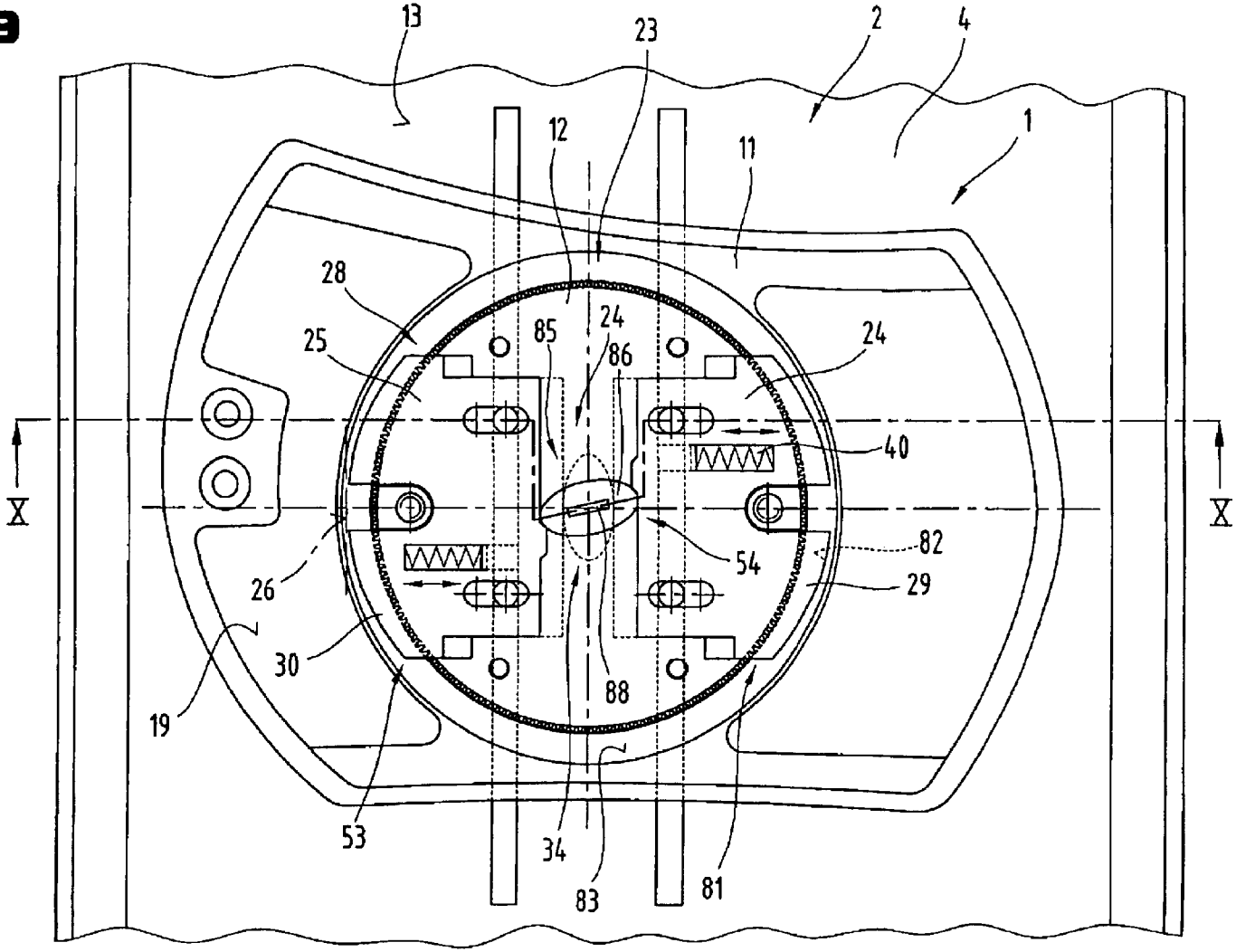
FIG. 9 is a plan view of another embodiment of the adjusting mechanism on the retaining disc and a guide arrangement by means of which the binding unit can be displaced relative to a board-type sports device.
Figure 10:
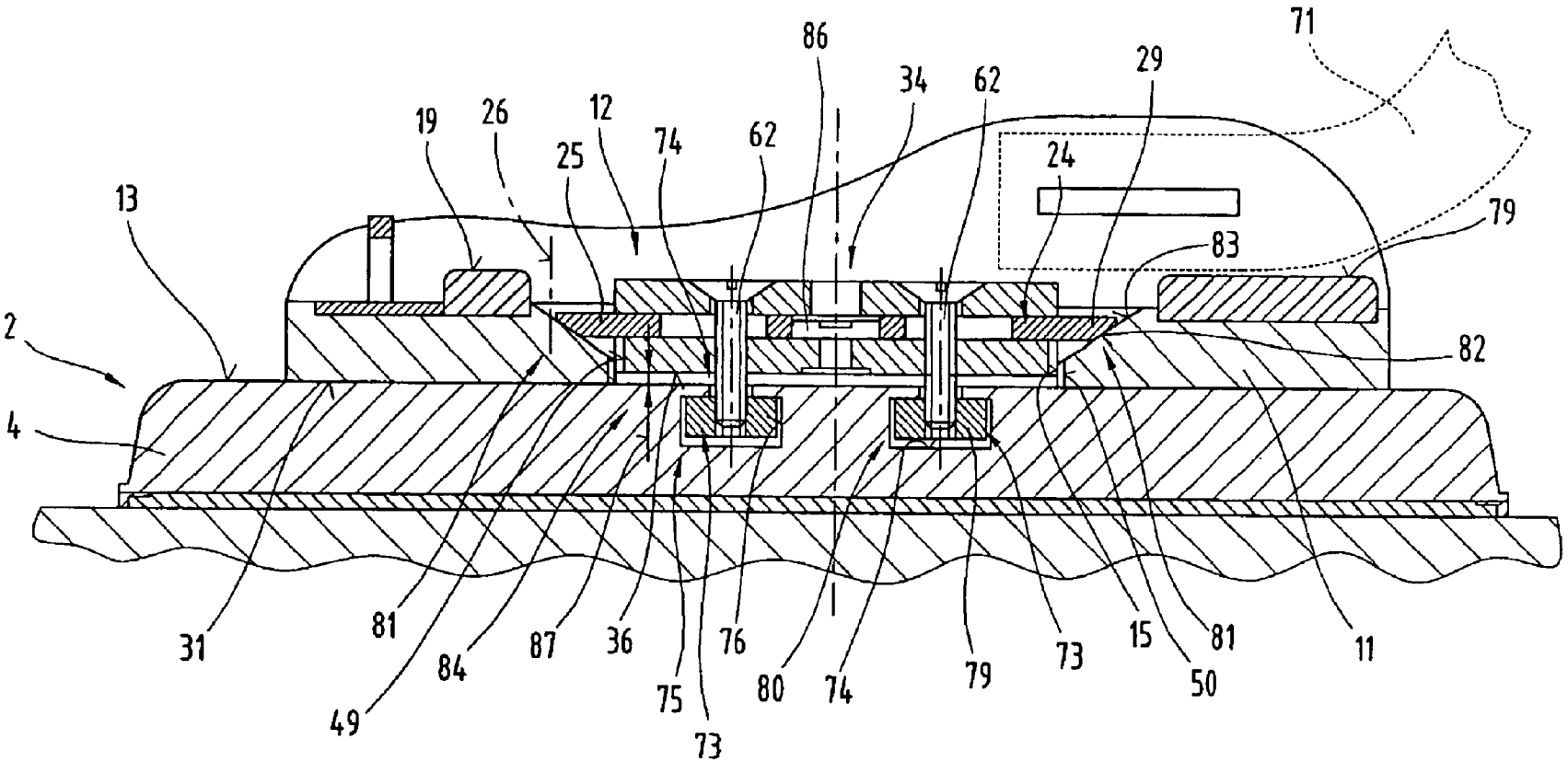
FIG. 10 is a section along the lines X—X indicated in FIG. 9, showing component parts of the binding unit affording the option of rapidly adjusting the angular position and altering the relative position of the binding unit with respect to the sports device.
Figure 11:
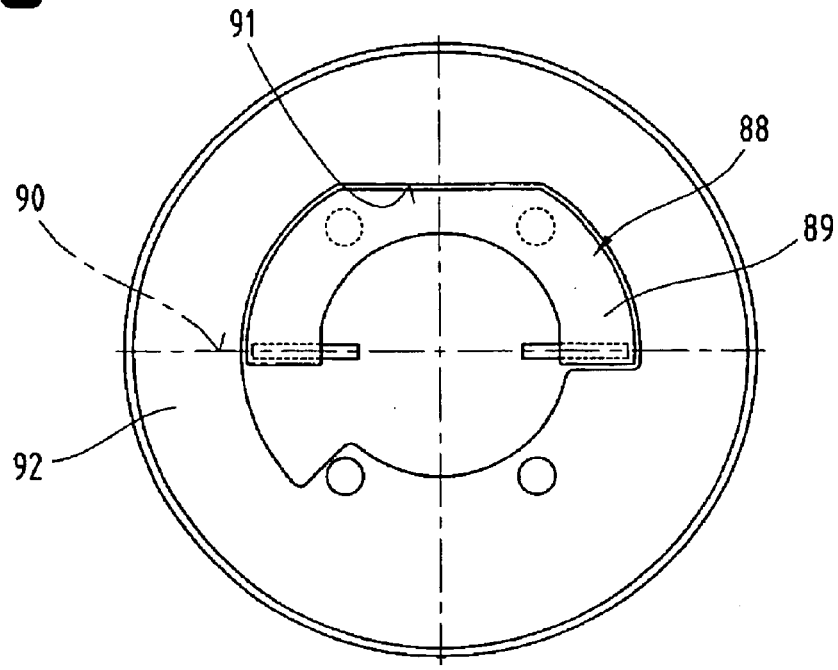
FIG. 11 is a simplified, schematic diagram in plan view of another embodiment of the retaining disc for the base plate, with a handler for operating various functions.

FIGS. 8 to 10 illustrate another embodiment or a variant of the binding unit 1 proposed by the invention. The same reference numbers are used for the parts already described above and the above descriptions may be transposed in terms of meaning to same parts bearing the same reference numbers.

As may best be seen from FIG. 8, the binding unit 1 is mounted in pairs on a corresponding sports device 2, preferably on a snowboard 4.

In a variant of the invention, at least one positive connecting means 73 is provided on the bottom face 36 of the retaining disc 12, which positively connects with a complementary or matching positive connecting means 74 provided on the top face 13 of the snowboard 4, which may be seen in FIG. 10. The positive connecting means 73 of the retaining disc 12 simultaneously interacts with the connecting means 74 of the snowboard positively engaging with it to provide a guide arrangement 75 to permit a relative displacement if necessary between the retaining disc 12 or the entire binding unit 1 in the longitudinal direction of the snowboard 4.

The connecting means 74 of the snowboard 4 is preferably provided in the form of at least one, preferably two parallel guide grooves 76, 77 arranged in the top face 13 of the snowboard. This at least one guide groove 76, 77 for each binding unit 1 extends at least more or less parallel with the longitudinal direction or longitudinal axis 21 of the snowboard 4 and is preferably at least partially integrated in the structure thereof. By preference, the top face of the guide groove 76, 77 terminates flush with the top face 13 of the snowboard 4. The guide grooves 76, 77 are preferably of metal, for example aluminium, or a hard plastics material that will guarantee the requisite degree of strength. A length of the connecting means 74 in the snowboard 4 corresponds more or less to the desired displacement path of each binding unit 1 and may therefore be approximately 4 cm to 20 cm in length. As an alternative to the embodiment illustrated as an example here, it would naturally also be possible for the two binding units 1 to have a common guide arrangement 75 to permit a relative displacement independently of one another if necessary and then locking on the snowboard 4.

By means of the guide arrangement 75 which enables the binding units 1 to be to locked and released in a translating arrangement in the longitudinal direction of the snowboard 4 as required, the relative position of each binding unit 1 to the sports device 1 can be changed or adjusted and a distance 78 between the two binding units 1 set as desired. By releasing the displacement function in the longitudinal direction of the snowboard 4, the guide arrangement 75 permits a relative displacement between the binding unit 1 as a whole and the snowboard 4 but prevents the retaining disc 12 and the binding unit 1 as a whole from being lifted off the top face 13 of the snowboard 4.

The positive connecting means 73 of the retaining disc 12 is preferably provided in the form of at least one projection 79 standing proud of the mostly planar bottom face thereof, which can be displaced in positive engagement with the connecting means 74 of the snowboard 4, as may be seen most clearly from FIG. 10. In the engaged state, this positive connection between the retaining disc 12 and the snowboard 4 therefore prevents the retaining disc 12 from being lifted off or removed from the top face 13 of the snowboard 4.

The preferably at least two projections 79 may be provided in the form of slide blocks, flange nuts, expanding anchoring elements or similar, displaceable in the guide grooves 76, 77 of the snowboard 4. The projections 79 may be at least one fixing screw 62 for the retaining disc 12 or separate screws, standing proud of or projecting from the bottom face 36 of the retaining disc 12. Alternatively, it would naturally also be possible to provide integrally moulded projections 79 on the bottom face 36 of the retaining disc 12. In particular, projections 79 with a cross section of a rectangular or dovetail shape may be moulded on the bottom face 36 of the retaining disc 12. As will be explained below, in the case of the embodiment illustrated in FIG. 10, it is not absolutely necessary to tighten the fixing screws 62 in order to prevent a relative displacement of the binding unit 1 in the longitudinal direction of the snowboard 4 in spite of the guide arrangement 75.

As an alternative embodiment, it would naturally also be within the scope of the invention to provide the positive connecting means 73 of the retaining disc 12 in the form of at least one groove-shaped recess on its bottom face 36 and the positive connecting means 74 on the snowboard 4 in the form of a complementary or matching ledge-shaped raised portion, thereby accomplishing a vertical positive connection 80 and a relative displaceability between the retaining disc 12 and the snowboard 4 in the longitudinal direction thereof.

A positive connection 80 obtained between the connecting means 73 and 74 will therefore permit a relative displacement of the binding unit 1 and at least the retaining disc 12 in the longitudinal direction of the snowboard 4 but will prevent these parts from being lifted off or removed from the top face 13 of the snowboard 4.

Displacement of the binding unit 1 and the retaining disc 12 relative to the snowboard 4 is selectively released and locked by means of clamping forces, which are selectively accumulated between the snowboard 4 and the binding unit 1 and can be increased still further if necessary. This clamping action is preferably activated and deactivated by the adjusting mechanism 34 used to set the rotation angle, in particular the slide elements 24, 25. To this end, at least one inclined surface 81 is provided in the spanning or transition region 28 between the retaining disc 12 or slide elements 24, 25 thereof and the peripheral region and the orifice 15 in the base plate 11. This inclined surface 81 has at least one clamping surface 82, 83. These clamping surfaces 82, 83 are preferably defined by the external face of a truncated cone. A circular or segment-shaped clamping surfaces 82, 83 is preferably provided both around the orifice 15 of the base plate 11 and in opposing end regions 29, 30 of the slide elements 24, 25, inclined at an angle to the top face 13 and to the standing plane 19. Alternatively, it would naturally be possible to provide corresponding clamping surfaces 82, 83 around the orifice 15 only or in the end regions 29, 30 of the slide elements 24, 25 only. The clamping surfaces 82 are provided on the bottom faces of the slide elements 29, 30.

In particular, the clamping surfaces 82, 83 extend from the standing plane 19 on the base plate 11 in the direction towards the bottom face 31 of the base plate 11 and are inclined accordingly towards the centre of the retaining disc 12. The inclined surface 81 and the clamping surface 83 of base plate 11 may also be described as a depression of the base plate 11 on the top face thereof around the orifice 15.

The purpose of the clamping system 84 described above between the retaining disc 12 or between the binding unit 1 and the snowboard 4 is explained below. When the slide elements 24, 25 are in the inserted position, the clamping system 84 of the binding unit 1 is deactivated and the binding unit 1 can be displaced relative to the snowboard 4 and the rotation angle of the binding unit 1 relative to the sports device 2 can be altered. When the slide elements 24, 25 are in the extracted position 26, the clamping system 84 is activated via the inclined surface 81, preventing a relative displacement of the binding unit in the longitudinal direction of the sports device 2 and any rotation of the binding unit 1 about its vertical axis. When the slide elements 24, 25 are in the extracted position 26, the retaining disc 11 is at least slightly raised above the top face 13 of the snowboard 4 via the inclined surfaces 81. As a result, the bottom face 31 of the base plate 11 is applied firmly against the top face 13 of the snowboard 4 and firmly against the guide arrangement 75. This clamping or contact force between base plate 11 and snowboard 4 is already sufficient to prevent the binding unit 1 from being displaced relative to the guide arrangement 75. A clamping or retaining force to prevent the binding unit 1 from being displaced relative to the snowboard 4 can additionally be built up between the positive connecting means 73, 74, in particular between the guide grooves 76 of the snowboard 4 and the projections 79 of the retaining disc 12, resulting in high fixing and retaining torques overall.

This embodiment is of particular advantage because operation or manipulation of a single adjusting mechanism 34 is all that is needed to selectively lock and release the angular adjustability and the longitudinal adjustability of the binding unit 1.

As may best be seen from FIG. 9, the adjusting mechanism 34 for the angular adjustment and longitudinal adjustment of the binding unit 1 may be provided in an eccentric arrangement 85 rather than the design described above. This eccentric arrangement 85 may be provided in the form of a dual rod-link drive, drivingly linked to the slide elements 24, 25. The adjusting mechanism 34 for synchronously coupling the two slide elements 24, 25 in displacement may also be provided in the form of a cam driver 86 with a double cam mounted at the centre of the retaining disc 12 so as to be rotatable to a limited degree. The adjusting mechanism 34 can be easily checked by means of detent elements or by rotating the cam driver 86 away from a dead centre position, as illustrated in FIG. 9. Accordingly, the slide elements 24, 25 are forced into the inserted position by the spring means 40. When the cam driver 86 or cam is rotated into the position indicated by broken lines, the slide elements 24, 25 are shifted to the inserted position, allowing the base plate 11 to be lifted off the retaining disc 12.

This type of adjusting mechanism 24 therefore enables a plurality, in particular two slide elements 24, 25 to be synchronously coupled in motion to effect a relative displacement in opposite adjustment directions.

In order to be able to activate and deactivate the clamping system 84 simultaneously by means of this adjusting mechanism 34, a limited, at least a slight vertical displacement 87 is permissible between the retaining disc 12 and the top face 13 of the snowboard 4 when the positive connection or positive fit 80 is established between the retaining disc 12 and the sports device 4.

By operating the adjusting mechanism 34 accordingly, the slide elements 24, 25 are forced apart from one another, at least approximately radially relative to the retaining disc 12. Consequently, the retaining disc 12 is raised slightly above the snowboard 4 via the inclined surfaces 81 until the projections 79 of the retaining disc 12 finally clamp or move into abutment in at least one of the guide grooves 76, 77. At the same time, the base plate 11 is pushed down against the top face 13 of the snowboard 4. The clamping force is therefore generated on the one hand between the connecting means 73 and 74 and also between the base plate 11 and the snowboard 4. The retaining force of the binding unit 1 against the snowboard 4 can be very much influenced by dimensioning and designing the clamping surfaces accordingly and by an appropriate selection of friction coefficients of the compressed surfaces.

FIGS. 11 to 14 illustrate another embodiment of the retaining disc 12 and one possible variant of the binding unit 1 proposed by the invention. The same reference numbers are used for parts already described above and the relevant parts of the description may be applied to same parts bearing the same reference numbers.

Figure 12:
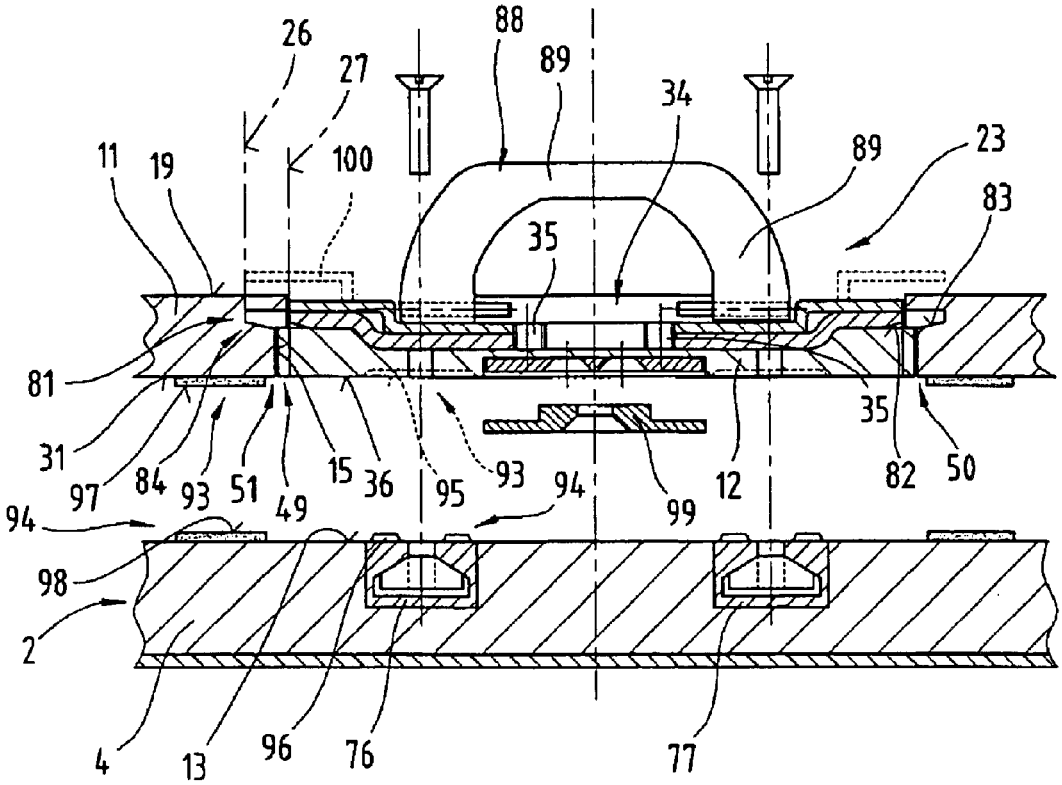
FIG. 12 is a simplified, schematic diagram, seen in section, of the retaining disc with positive connecting means for connecting the binding unit to a sports device designed accordingly.

In this instance, four slide elements 24, 25 are provided, which are mounted so as to be displaceable in an almost radial arrangement at the centre of the circular retaining disc 12. Again, teeth 49 are provided on the circumference of the retaining disc 12, these teeth extending parallel with the axis of rotation of the retaining disc 12. In the orifice 15 of the base plate 11 are matching or complementary teeth 51, forming a high-strength anti-rotation lock 50 between the retaining disc 12 and the base plate 11 when these two parts are assembled, as illustrated in FIG. 12. The teeth 49, 51 are laid out so that a rotation angle between the retaining disc 12 and the base plate 11 is possible in stages of approximately 3°.

The retaining disc 12 also has the adjusting mechanism 34, enabling all the slide elements 24, 25 to be synchronously displaced relative to the retaining disc 12 and relative to their toothed peripheral region 33. In the embodiment illustrated as an example here, the adjusting mechanism 34 in turn has a driving gear or pinion 35 mounted so as to be displaceable at the centre of the retaining disc 12, its peripheral region being drivingly connected to the facing end regions of the slide elements 24, 25. When the pinion 35 is rotated, the slide elements 24, 25 can therefore be moved in and out, depending on the direction of rotation of the pinion 35, relative to the peripheral region 33 of the retaining disc 12.

The release and locking mechanism 54 for the adjusting mechanism 34 in this case is provided in the form of a bow-shaped operating element 88. This operating element 88 is firstly used to operate the adjusting mechanism 34, in particular to make it easier to turn the pinion 35, and also for selectively locking and releasing its ability to rotate. This operating element 88 therefore also constitutes a handle 89 enabling the adjusting mechanism 34 to be more readily operated and with more force. Relatively high clamping forces may be generated by means of this handle 89 for the adjusting mechanism 34, which may be forcefully or lightly gripped by the user, enabling the binding unit 1 to be securely fixed in the desired angular position and relative position relative to a snowboard 4. As may be best be seen from FIGS. 11 and 12, the handle 89 is mounted so as to be pivotable about at least one axis 90 aligned parallel with the standing plane 19 for a sports shoe so that the handle 89 can be selectively pivoted up and down from a non-operating position parallel with and in the standing plane 19 into an active position in which it is lifted up from and stands proud of the standing plane 19. The non-operating position of the handle 89 is visible in FIG. 11. In this non-operating position, the handle 89 simultaneously constitutes an anti-rotation lock 91 for the pinion 35 since it is at least partially in positive engagement with the retaining disc 12 and with a cover element 92 for the adjusting mechanism 34 of the retaining disc 12.

The adjusting and fixing mechanism 23 for the binding unit 1 relative to the snowboard 4 also has a clamping system 84, by means of which the binding unit 1 can be selectively released and locked on the snowboard 4 to adjust a rotation angle and optionally for adjusting the relative position. Again, inclined surfaces 81 and clamping surfaces 82, 83 are also provided in the outer end regions of the slide elements 24, 25 laid out in a star shape, which enable the binding unit 1 to be fixed against the snowboard 4 solely by clamping forces.

In order to increase the clamping and retaining force of the binding unit 1 against the snowboard 4, additional positive and/or friction-enhancing means 93, 94 may be provided between the bottom face 31 of the base plate 11 and between the bottom face 36 of the retaining disc 12 and the top face of the snowboard 4. However, it is not absolutely necessary to provide the means 93, 94 both on the binding side and on the snowboard side and it would also be conceivable for the means 93, 94 intended to increase the retaining force of the binding unit 1 against the snowboard 4 to be provided on the snowboard only or on the binding unit 1 only. These means 93, 94 may be tooth systems 95, 96 between the retaining disc 12 and preferably the track-type guide groove 76 on the snowboard 4. Irrespective of the above or in combination with this system, it would also be possible to provide friction-enhancing means 93, 94 between the bottom face 31 of the base plate 11 and/or the bottom face 36 of the retaining disc 12 and the top face 13 of the snowboard 4, e.g. resilient elastic or roughened friction surfaces 97, 98. These friction surfaces 97, 98 are preferably provided between the base plate 11 and the top face 13 of the snowboard 4. The friction surfaces 97, 98 may be provided in the form of elastomer materials, e.g. rubber-type insert or mounting parts, which will generate high retaining torques when a slight contact pressure is applied, thereby enabling a high retaining force of the binding unit 1 to be obtained and avoiding any undesirable movements relative to the snowboard 4, in spite of the fact that the clamping system 84 comprises such simple mechanical means.

As may best be seen from FIG. 12, the guide grooves 76, 77 in the snowboard 4 may be in the shape of a dovetail or trapezoidal in cross section. Matching flange nuts or slide blocks may be guided in these guide grooves 76, 77, either connected to the retaining disc 12 by simple screws or alternatively formed as an integral unit with the retaining disc 12.

The retaining disc 12 may be made from an injection-moulded hard plastics, amongst other things. To provide a high-strength mounting for the adjusting mechanism 34, in particular the pinion 35, individual bearing parts 99 may be made from metal and mounted on the retaining disc 12.

The base plate 11 as such may be removed from the retaining disc 12 and from the snowboard 4 as a whole when the slide elements 24, 25 have been shifted to the inserted position 27 by the adjusting mechanism 94. Optionally, an anti-liftoff restriction 100 may be provided on the retaining disc 12, as indicated by broken lines. This anti-liftoff restriction 100 enables the base plate 11 to be lifted off the retaining disc 12 and from the snowboard 4 to a limited degree. In this raised state, the base plate 11 can be rotated relative to the retaining disc 12 but is prevented from being removed as a whole and the base plate 11 is prevented from falling off the snowboard 4. This anti-lift off restriction 100 may be provided in a simple manner in the form of elements projecting out from the retaining disc 12.

For the sake of good order, it should finally be pointed out that in order to provide a clearer understanding of the structure of the binding unit 1 and the retaining disc 12, they and their constituent parts have been illustrated out of scale to a certain extent and/or on an enlarged and/or reduced scale.

The tasks underlying the independent inventive solutions can be found in the description.

Above all, subject matter relating to the individual embodiments illustrated in FIGS. 1; 2, 3, 4, 5, 6, 7; 8, 9, 10; 11, 12; 13, 14 can be construed as independent solutions proposed by the invention. The tasks and solutions can be found in the detailed descriptions relating to these drawings.

| List of Reference Numbers | |
|---|---|
| 1 | Binding unit 1 |
| 2 | Sports device |
| 3 | Sports shoe |
| 4 | Snowboard |
| 5 | Snowboard shoe |
| 6 | Coupling part |
| 7 | Coupling part |
| 8 | Coupling part |
| 9 | Coupling part |
| 10 | Catch coupling |
| 11 | Base plate |
| 12 | Retaining disc |
| 13 | Top face |
| 14 | Diameter |
| 15 | Orifice |
| 16 | Pivot bearing |
| 17 | Axis |
| 18 | Binding longitudinal axis |
| 19 | Standing plane |
| 20 | Rotary angle |
| 21 | Longitudinal axis |
| 22 | Fixing screw |
| 23 | Adjusting and fixing mechanism |
| 24 | Slide element |
| 25 | Slide element |
| 26 | Extracted position |
| 27 | Inserted position |
| 28 | Transition region |
| 29 | End region |
| 30 | End region |
| 31 | Bottom face |
| 32 | Top face |
| 33 | Peripheral region |
| 34 | Adjusting mechanism |
| 35 | Pinion |
| 36 | Bottom face |
| 37 | Axis |
| 38 | Portion |
| 39 | Portion |
| 40 | Spring means |
| 41 | Helical spring |
| 42 | Helical spring |
| 43 | Recess |
| 44 | Recess |
| 45 | Thrust bearing |
| 46 | Thrust bearing |
| 47 | Support surface |
| 48 | Support surface |
| 49 | Teeth |
| 50 | Anti-rotation lock |
| 51 | Teeth |
| 52 | Mounting plane |
| 53 | Anti-liftoff lock |
| 54 | Release and locking mechanism |
| 55 | Push-button |
| 56 | Release position |
| 57 | Locking position |
| 58 | Lock nose |
| 59 | Spring element |
| 60 | Recess |
| 61 | Recess |
| 62 | Fixing screw |
| 63 | Fixing hole |
| 64 | Fixing hole |
| 65 | Fixing hole |
| 66 | Fixing hole |

-continued

| List of Reference Numbers | |
|---|---|
| 67 | Guide element |
| 68 | Guide recess |
| 69 | Guide pin |
| 70 | Heel support |
| 71 | Mounting bracket |
| 72 | Pivot axis |
| 73 | Connecting means |
| 74 | Connecting means |
| 75 | Guide arrangement |
| 76 | Guide groove |
| 77 | Guide groove |
| 78 | Distance |
| 79 | Projection |
| 80 | Positive connection |
| 81 | Inclined surface |
| 82 | Clamping surface |
| 83 | Clamping surface |
| 84 | Clamping mechanism |
| 85 | Eccentric arrangement |
| 86 | Cam driver |
| 87 | Vertical displacement |
| 88 | Operating element |
| 89 | Handle |
| 90 | Axis |
| 91 | Anti-rotation lock |
| 92 | Cover element |
| 93 | Means |
| 94 | Means |
| 95 | Tooth arrangement |
| 96 | Tooth arrangement |
| 97 | Friction surface |
| 98 | Friction surface |
| 99 | Bearing part |
| 100 | Anti-liftoff restriction |

What is claimed is:

1. Binding unit for a snowboard, comprising, for the purpose of fixing it to the snowboard, a retaining disc, which is substantially circular as seen in plan view, for a base plate of relatively large surface area, coupling parts mounted directly or indirectly thereon to provide a connection to a snowboard shoe, which is releasable from the snowboard, the retaining disc being inserted in a central orifice or corresponding recess of the base plate such that a perimeter of the retaining disc does not extend beyond a perimeter of the central orifice or corresponding recess teeth between the base plate and the retaining disc, the teeth securely fixing selectively adjustable and fixable angular positions between the retaining disc and the base plate, and at least one slide element on the retaining disc, the at least one slide element being displaceable between an extracted position, in which the at least one slide element at least partially covers the base plate and an inserted position, in which the slide element does not span or overlap the transition region between the retaining disc and the base plate, the at least one slide element in the extracted position preventing the base plate from being lifted off the retaining disc in a direction perpendicular to its mounting plane while enabling the base plate to be lifted off the retaining disc in the inserted position.

2. Binding unit according to claim 1, comprising at least two of said slide elements displaceably mounted on the retaining disc in a diametrically opposite arrangement or distributed around a peripheral region thereof, portions thereof projecting out from the circular circumferential region of the retaining disc in their extracted position.

3. Binding unit according to claim 1, wherein the at least one slide element is displaceable at least substantially radially to the retaining disc.

4. Binding unit according to claim 1, comprising an adjusting mechanism designed to adjust several of said slide elements in opposite directions synchronously and coupled in displacement.

5. Binding unit according to claim 4, wherein the adjusting mechanism is a pinion or driving gear disposed at the center of the retaining disc and drivingly connected to the slide elements.

6. Binding unit according to claim 1, comprising at least one spring means, which forces the at least one slide element into the extracted position.

7. Binding unit according to claim 6, wherein the spring means is at least one helical spring disposed on the retaining disc, the at least one helical spring continuously forcing at least one slide element into the extracted position and into a position producing a positive coupling with the base plate.

8. Binding unit according to claim 1, wherein the retaining disc is a gear with teeth on its end face.

9. Binding unit according to claim 1, wherein the teeth comprise straight teeth on the retaining disc and on the base plate inside the orifice for receiving the retaining disc.

10. Binding unit according to claim 9, wherein, when the retaining disc is inserted in the base plate, the corresponding teeth form a mutual anti-rotation lock relative to their mounting plane.

11. Binding unit according to claim 1, comprising a release and locking mechanism for selectively releasing and locking displacement of the at least one slide element.

12. Binding unit according to claim 11, wherein the release and locking mechanism is a spring-biassed push-button, which is selectively displaceable into and out of positive engagement with the at least one slide element.

13. Binding unit according to claim 11, wherein the release and locking mechanism is a means of deactivating the retention of the at least one slide element against the action of spring means in the inserted position.

14. Binding unit according to claim 11, wherein the release and locking mechanism is designed to securely fix the at least one slide element in the extracted position.

15. Binding unit according to claim 11, wherein, when the release and locking mechanism is released, the at least one slide element is automatically shifted by spring means from the inserted position into the extracted position.

16. Binding unit according to claim 11, wherein the release and locking mechanism is designed to selectively release and lock the rotating motion of a pinion or driving gear for the slide elements.

17. Binding unit according to claim 16, wherein the release and locking mechanism comprises an operating handle for rotating the pinion or driving gear.

18. Binding unit according to claim 17, wherein the handle is pivotable about an axis aligned parallel with a standing plane for the sports shoe, between a non-operating position in which it lies in the standing plane and an active position folded out from the standing plane.

19. Binding unit according to claim 18, wherein, in the non-operating position, the handle forms an anti-rotation lock for the pinion.

20. Binding unit according to claim 1, wherein, when the angular position of the base plate is changed, the retaining disc remains rigidly joined to the snowboard by means of fixing screws.

21. Binding unit according to claim 1, wherein the retaining disc constitutes a pre-assembled unit with the snowboard.

22. Binding unit according to claim 1, wherein the retaining disc has guide elements for linearly guiding the at least one slide element.

23. Binding unit according to claim 1, wherein the base plate has a contour substantially the shape of a shoe sole.

24. Binding unit according to claim 1, comprising at least one positive connecting means on a bottom face of the retaining disc for establishing a positive connection with a corresponding connecting means on the top face of the snowboard.

25. Binding unit according to claim 24, wherein the positive connecting means of the retaining disc in conjunction with the corresponding or complementary shaped connecting means on the snowboard form a guide arrangement that is lockable and releasable to permit a relative adjustment of the binding unit in the longitudinal direction of the snowboard.

26. Binding unit according to claim 24, wherein the positive connecting means of the retaining disc is at least one projection standing proud of its bottom face which can be selectively displaced and fixed in at least one guide groove provided in the top face of the snowboard.

27. Binding unit according to claim 24, wherein the positive connecting means is at least one groove-shaped recess on the bottom face of the retaining disc, which is displaceable with a complementary or corresponding ledge-shaped raised portion on the snowboard in a positive and relative sliding connection.

28. Binding unit according to claim 24, wherein, when the at least one slide element is in the extracted position via inclined surfaces between co-operating contact surfaces between the positive connecting means, a clamping or retaining force is produced, which is sufficient to prevent a free or undesired relative displacement of the retaining disc or the entire binding unit in the direction of the longitudinal axis of the snowboard.

29. Binding unit according to claim 24, wherein the positive connective means permits a slight vertical displacement of the retaining disc relative to the top face of the snowboard when the at least one sliding element is in the inserted position.

30. Binding unit according to claim 1, comprising an anti-liftoff restriction on the retaining disc, which enables the base plate to rotate when lifted off the snowboard but prevents the base plate from being totally removed from the retaining disc.

31. Binding unit according to claim 24, wherein the at least one projection permits a relative displacement of the retaining disc or the entire binding unit in the longitudinal direction of the snowboard due to a slight vertical clearance when the at least one slide element is in the Inserved position.

32. Binding unit according to claim 27, wherein the at least one groove-shaped recess and ledge-shaped raised recess portion permit a relative displacement of the retaining disc or the entire binding unit in the longitudinal direction of the snowboard due to a slight vertical clearance when the at least one slide element is in the Inserved position.

33. Binding unit for a snowboard, comprising, for the purpose of fixing it to the snowboard, a retaining disc, which is substantially circular in plan view, for a base plate of relatively large surface area, coupling parts mounted directly or indirectly thereon to provide a connect, on to a snowboard shoe, which is releasable from the snowboard, the retaining disc being inserted in a central orifice or corresponding recess of the base plate such that a perimeter of the retaining disc does not extend beyond a perimeter of the central orifice or corresponding recess teeth between the base plate and retaining disc, the teeth securely fixing selectively adjustable and fixable angular positions between the retaining disc and the base plate, at least one slide element on the retaining disc, the at least one slide element being displaceable between an extracted position, in which the at least one slide element at least partially covers the base plate and an inserted position, and an adjusting and fixing mechanism between the retaining disc and the base plate, the adjusting and fixing mechanism comprising an anti-rotation lock and an anti-liftoff lock between the retaining disc and the base plate, and the adjusting and fixing mechanism in an inactive position enabling the base plate to be lifted off the retaining disc in a direction perpendicular to a top face of the retaining disc.

* * * * *